US006811289B2

(12) United States Patent
Nakata

(10) Patent No.: US 6,811,289 B2
(45) Date of Patent: Nov. 2, 2004

(54) LAMP DEVICE FOR A VEHICLE HAVING A FREE CURVED SURFACE AND A LENS WITHOUT A PRISM

(75) Inventor: Yutaka Nakata, Isehara (JP)

(73) Assignee: Ichikoh Industries, Ltd., Tokyo (JP)

( * ) Notice: Subject to any disclaimer, the term of this patent is extended or adjusted under 35 U.S.C. 154(b) by 398 days.

(21) Appl. No.: 10/051,369

(22) Filed: Jan. 22, 2002

(65) Prior Publication Data

US 2002/0145370 A1 Oct. 10, 2002

(30) Foreign Application Priority Data

Jan. 22, 2001 (JP) ..... 2001-013892
Jan. 22, 2001 (JP) ..... 2001-013894
Jan. 22, 2001 (JP) ..... 2001-013895

(51) Int. Cl.[7] ..... F21V 7/00; H01J 5/16

(52) U.S. Cl. ..... 362/516; 362/507; 362/297; 362/299; 313/113

(58) Field of Search ..... 313/113; 362/516, 362/514, 507, 296, 299, 308

(56) References Cited

U.S. PATENT DOCUMENTS 5,204,820 A 4/1993 Strobel et al.
5,432,685 A * 7/1995 Taksukawa et al. ..... 362/518
5,440,456 A * 8/1995 Bertling et al. ..... 362/520
5,897,196 A * 4/1999 Soskind et al. ..... 362/507
6,079,854 A * 6/2000 Ra ..... 362/342
6,123,440 A * 9/2000 Albou ..... 362/516
6,527,425 B1 * 3/2003 Nakata ..... 362/516

FOREIGN PATENT DOCUMENTS

JP 2001-035215 2/2001

OTHER PUBLICATIONS

D.F. Rogers et al., "Mathematical Elements for Computer Graphics", 2nd Edition, McGraw–Hill, Inc. (1990) pp. 445–446.

* cited by examiner

*Primary Examiner*—Ashok Patel
*Assistant Examiner*—Karabi Guharay
(74) *Attorney, Agent, or Firm*—Foley & Lardner LLP

(57) ABSTRACT

A lens has a concave shape or a convex shape in either vertical cross section or transverse cross section. Thereby light passing through the lens is largely refracted and the interior is harder to be seen even if a prism is not formed. As a result, there is no need to give a finish more than optical performance required for reflection to the front surface of the reflecting surface of a reflector, which is for the purpose of enhancement of its appearance, and thereby the machining work is simpler than the conventional way. Further, since the lens has a flat shape in either vertical cross section or transverse cross section, the lens is easily polished when it is made of glass, which is excellent in manufacture of the lens.

32 Claims, 56 Drawing Sheets

LAMP DEVICE FOR A VEHICLE HAVING A FREE CURVED SURFACE AND A LENS WITHOUT A PRISM

FIELD OF THE INVENTION

The present invention relates to a lamp device for vehicle such as a vehicle headlamp and a vehicle fog lamp for illuminating ahead of a vehicle. More particularly, this invention relates to the lamp device for vehicle with a light distribution function imparted mainly to a reflector side.

BACKGROUND OF THE INVENTION

Lamp device for vehicles lately have a light distribution function imparted to a reflector side by shaping a reflecting surface of the reflector as a free curved surface. The latest lamp device for vehicles use so called permeable lens as a lens and have an outer cover function in the lens side. This permeable lens is not provided with a prism for light distribution, so that light passes through the lens as it is without refraction. That is, the permeable lens is formed of a plate-like (flat plate or curved plate) light transmitting member such as only a simple plate glass.

In the conventional lamp device for vehicles, however, the internal reflecting surface of the reflector is clearly seen through the permeable lens from the outside. Therefore, the conventional lamp device for vehicles require giving a finish more than optical performance required for reflection to the reflecting surface of the reflector, which is for the purpose of enhancement of its appearance, so that the machining work is complicated.

To solve the problem, the inventor of this invention has invented a lamp device for vehicle (Japanese Patent Application No. 11-209331 (Japanese Patent Application Laid-Open No. 2001-35215)) by which the interior is harder to be seen as compared to the permeable lens.

SUMMARY OF THE INVENTION

It is an object of this invention is to provide a lamp device for vehicle, by which a surface finish is more easily given to the reflecting surface of a reflector than the conventional way by making the interior harder to be seen as compared to the permeable lens.

It is another object of this invention to provide a lamp device for vehicle whose lens is easily polished when it is made of glass by forming the shape of the lens to be flat in vertical cross section or transverse cross section, which is excellent in manufacture of the lens.

In order to achieve the objects, this invention provides a lens having a concave shape or a convex shape in either one of vertical cross section and transverse cross section while having a flat shape in the other one of these sections.

As a result, this invention provides the lens that forms a concave shape or a convex shape in either one of vertical cross section and transverse cross section, and thereby the interior is harder to be seen because the light passing through the lens is largely refracted even if a prism is not provided. This invention does not therefore require giving a finish more than optical performance required for reflection to the front surface of the reflecting surface of the reflector, which is for the purpose of enhancement of its appearance, and thereby the machining work is simpler than the conventional way.

In this invention, the lens has a flat shape in the other one of vertical cross section and transverse cross section. Therefore, the lens, which is made of glass, can be easily polished and is therefore excellent in its manufacture.

Other objects and features of this invention will become understood from the following description with reference to the accompanying drawings.

DETAILED DESCRIPTIONS

Figure 1:
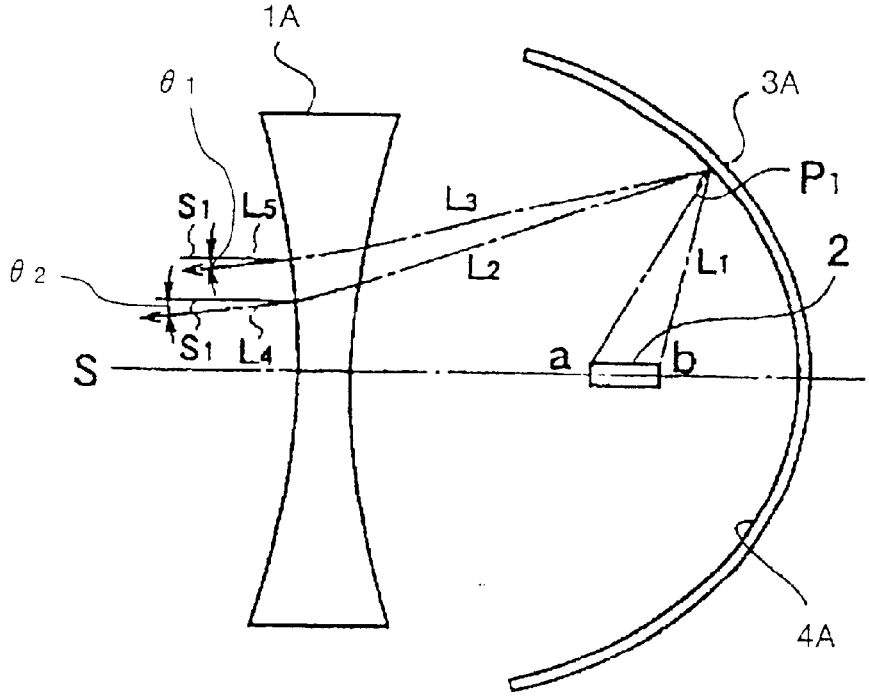
FIG. 1 is a vertical sectional view schematically showing a vehicle headlamp according to a first embodiment of this invention.

Four embodiments of the lamp device for vehicle according to this invention will be explained below with reference to the attached drawings. It should be noted that this invention is not limited by these embodiments.

The first to fourth embodiments provide explanation about a vehicle headlamp with which a low-beam light distribution pattern (light distribution pattern used when vehicles pass each other) can be obtained. This invention is also applicable to some other lamp device for vehicles. For example, this invention is applicable to a vehicle headlamp with which a high-beam light distribution pattern, light distribution pattern for highway driving, and a light distribution pattern for city driving, or the like can be obtained, or applicable to a vehicle fog lamp with which a light distribution pattern used under heavy fog is obtained.

The respective vehicle headlamps according to the first to fourth embodiments are mounted on vehicles specific to left-side driving. Therefore, for the vehicle headlamp mounted on vehicles specific to right-side driving, the right-hand side and the left-hand side in the figures are to be seen the other way around.

FIG. 1 to FIG. 20 show a first embodiment.

The vehicle headlamp according to the first embodiment comprises the lens 1A disposed on the front of a lamp housing (not shown), light source 2, and the reflector 3A. In the figures, the legend S represents an optical axis.

As shown in FIG. 1 to FIG. 4, the lens 1A has an outside shape of a laterally elongated rectangle when viewed from the front side, a concave shape in vertical cross section, and a flat shape in transverse cross section (a shape whose outer surface and inner surface are substantially parallel and wall thickness is substantially constant). The lens 1A is not provided with a prism for light distribution. Non-Uniform Rational B-Spline Surface (NURBS) as a free curved surface for light distribution is formed on the front surface and the rear surface of the lens 1A. The lens 1A may be made of glass or resin, and it is made of glass in the first embodiment. When the lens 1A uses such a glass-made lens, polishing is easy because it has a flat shape in transverse cross section, which is excellent in manufacture of the lens 1A.

The light source 2 uses, for example, a halogen lamp with a single filament or double filament, incandescent lamp, or electric discharge lamp (so called H1, H3, H4, H7, H11, etc.)

The internal surface of the reflector 3A is provided with a reflecting surface 4A such as NURBS as a free curved surface for light distribution. The reflecting surface 4A exhibits metallic high brightness by means of aluminum evaporation or silver color coating. The reflector 3A may be integrally formed with a lamp housing or may be formed as a single unit. The details of the reflecting surface 4A as NURBS are described in, for example, "Mathematical Elements for Computer Graphics" (Devid F. Rogers, J Alan Adams).

That is, the NURBS reflecting surface 4A when the NURBS lens 1A is used for its front surface and rear surface can be computed from a general equation of the following equation (1)

[Equation 1]

$$P(u, v) = \sum_{j=0}^{m} \sum_{k=0}^{n} P_{j,k} N_j, s(u) M_k, t(v) \tag{1}$$

Figure 2:
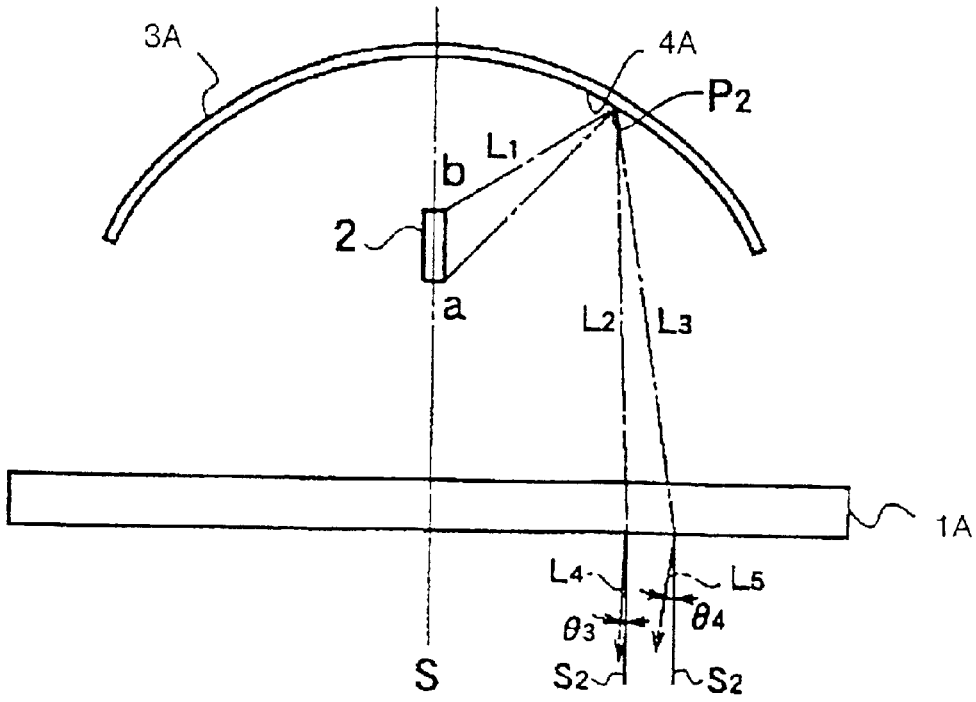
FIG. 2 is its transverse sectional view.

The NURBS reflecting surface 4A computed from the above equation (1) is a substantially ellipsoidal surface (the surface analogous to an ellipsoid) invertical cross section, which is larger than the lens 1A as shown in FIG. 1, and is a substantially paraboloidal surface (the surface analogous to paraboloid) in transverse cross section, which is almost the same in size as the lens 1A as shown in FIG. 2.

A parametric function of the general equation in the equation (1) is shown in the following equation (2).

By substituting a specific numerical value, for example, any point on the ellipsoid or paraboloid in the parametric function of the following equation (2), a specific reflecting surface 4A of the reflector 3A in a use of the lens 1A can be obtained. [Equation 2]

$$N_j s(u) = \begin{cases} 1 (\text{if } u_j \le u < u_{j+1}) \\ 0 \text{ (otherwise)} \end{cases} \tag{2}$$

$$N_j s(u) = \frac{u - u_j}{u_{j+s-1} - u_j} N_j, s-1(u) + \frac{u_{j+s} - u}{u_{j+s} - u_{j+1}} N_{j+1,s-1}(u)$$

$$M_k, t(v) = \begin{cases} 1 (\text{if } v_k \le v < v_{k+1}) \\ 0 \text{ (otherwise)} \end{cases}$$

$$M_k, t(v) = \frac{v - v_k}{v_{k+t-1} - v_k} M_{k,t-1}(v) + \frac{v_{k+t} - v}{v_{k+t} - v_{k+1}} M_{k+1,t-1}(v)$$

Figure 5:
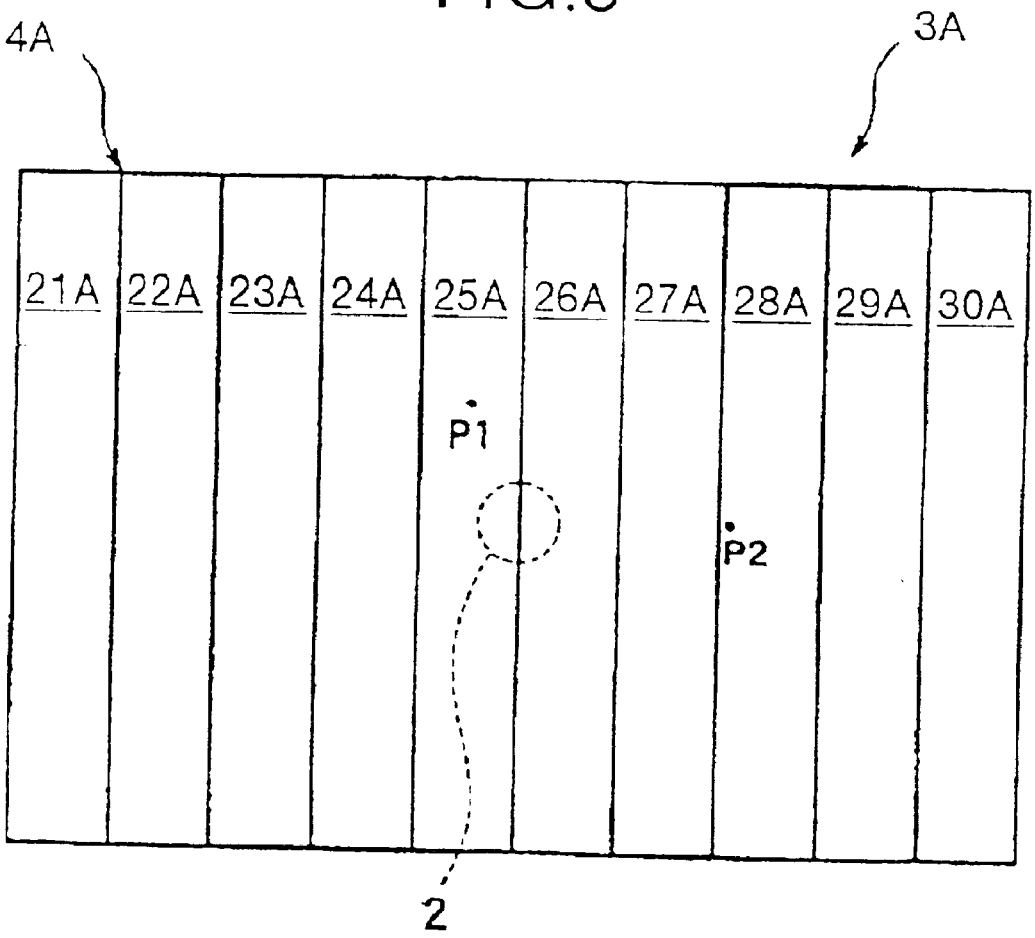
FIG. 5 is a front view of the reflecting surface.

An example of the specific reflecting surface 4A obtained in the above manner is shown in FIG. 5. The example of the reflecting surface 4A is longitudinally divided into 10 blocks. Boundaries (seams) of the 10-divided reflecting surface blocks (or reflecting surface segments) 21A, 22A, 23A, 24A, 25A, 26A, 27A, 28A, 29A, and 30A (21A to 30A) are sometimes visible independently from each other as shown in FIG. 5 and are sometimes not because they seem continuous.

The reflecting surface 4A shown in FIG. 5 is an example of the longitudinally divided reflecting surface blocks. Therefore, this invention may be any of laterally divided reflecting surface blocks, reflecting surface blocks obtained by being divided in a parabolic direction, or those obtained by being divided in any combined directions of the longitudinal direction, lateral direction, and parabolic direction, if necessary.

Since the reflecting surface 4A is provided with complex combination of reflecting surfaces as NURBS, as the optical axis S, the reflecting surface 4A does not have a single optical axis in the strict sense. However, there is only a slight amount of difference between plural optical axes and the surfaces therefore share substantially the identical optical axis. Based on this, in this specification and the figures, this substantially identical optical axis is referred to as pseudo optical axis (or simply optical axis) S. Likewise, as a focal point F (see FIG. 7C) on the reflecting surface 4A, it does not have a single focal point in the strict sense, but there is only a slight amount of difference between plural focal points, and the surfaces therefore share substantially the identical focal point. Based on this, in this specification and the figures, this substantially identical focal point is referred to as pseudo focal point (or simply focal point).

Figure 6:
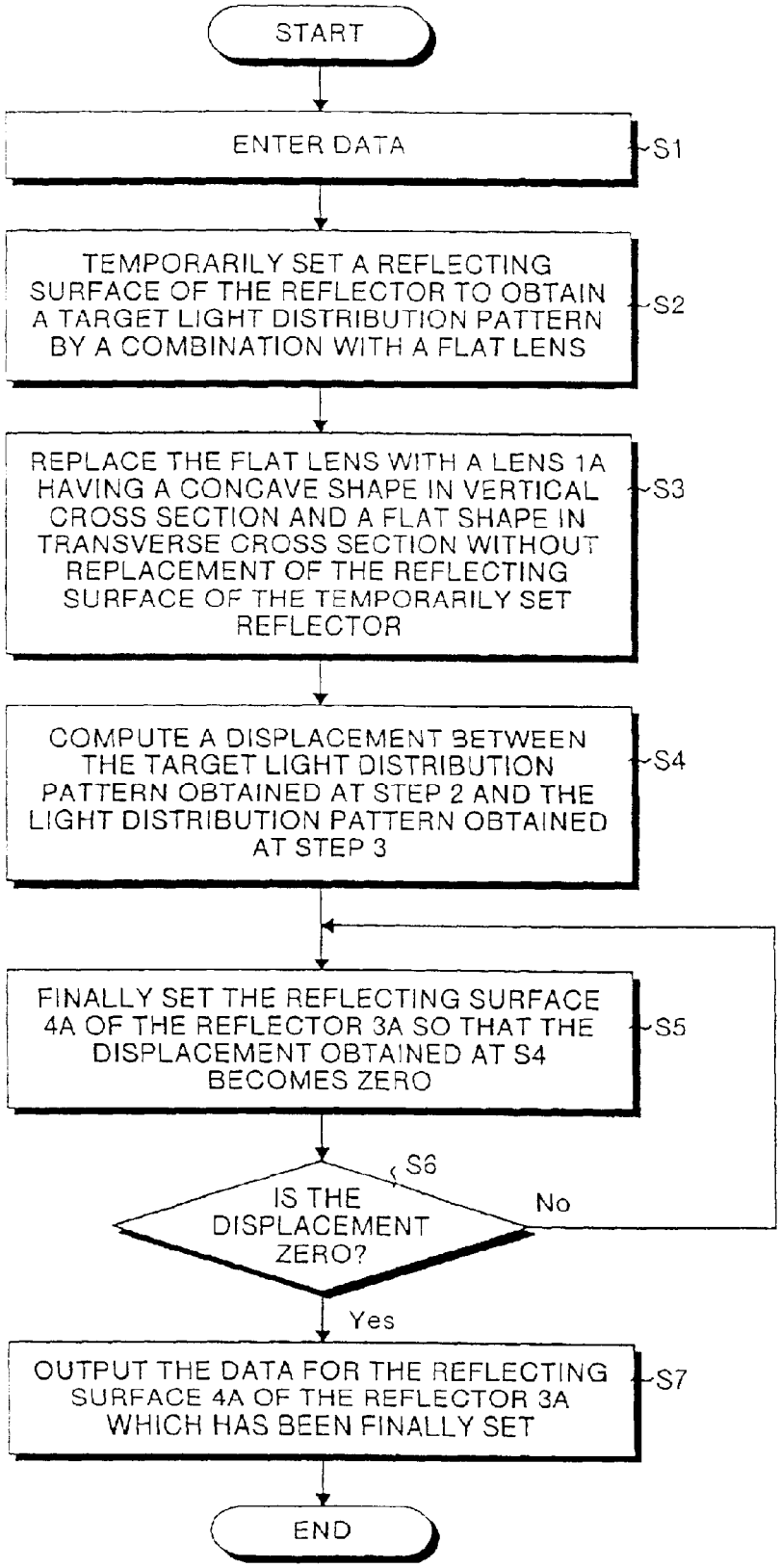
FIG. 6 is a flowchart showing the manufacture of the reflecting surface.
Figure 7B:
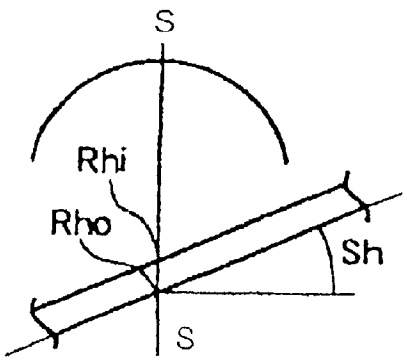
FIG. 7B is a cross-sectional view taken along the line B—B in FIG. 7A.
Figure 7A:
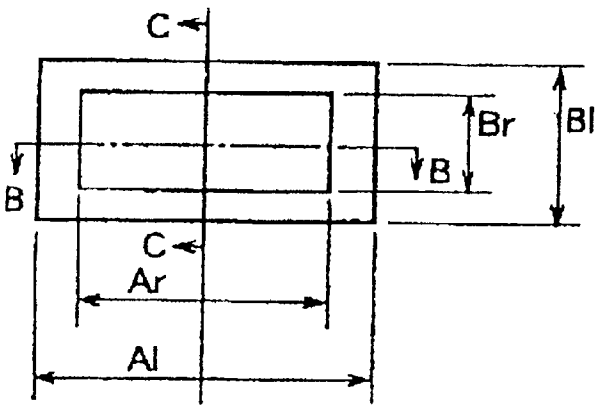
FIG. 7A is a front view for explaining data to be input to optical simulation.
Figure 7C:
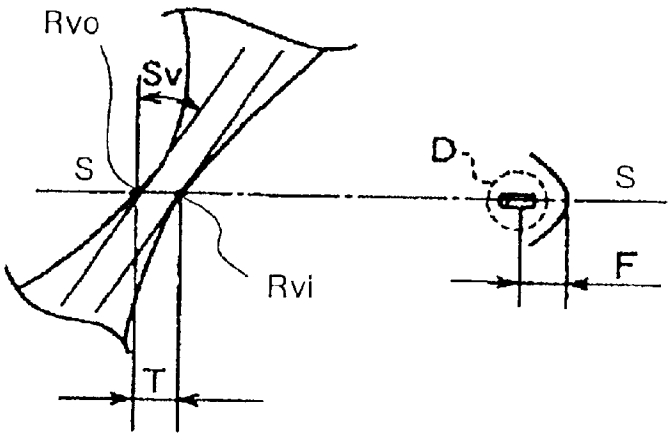
FIG. 7C is a cross-sectional view taken along the line C—C in FIG. 7A.
Figure 7D:
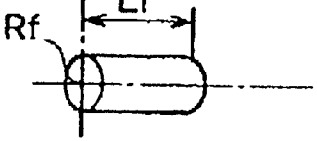
FIG. 7D is an enlarged view of the D portion in FIG. 7C.

An example of manufacture of the reflecting surface 4A will be explained below with reference to FIG. 6.

At step 1 (S1), data is entered to a microcomputer (not shown). This data is selected from, for example, design specifications of the database in consideration of design of vehicle headlamps and design of a vehicle with the vehicle headlamps mounted. This data includes a type of light source 2, a size of the reflector 3A and a surface shape of the reflecting surface 4A, division to the reflecting surface blocks 21A to 30A, a size and shapes of top and rear surfaces of the lens 1A, a target light distribution pattern, and the like.

At step 2 (S2), the processing for temporarily setting a reflecting surface of a reflector is performed so as to obtain a target light distribution pattern in combination with a flat lens based on the data entered at step 1. The reflecting surface of the temporarily set reflector is automatically set based on control points in a free curved surface as NURBS and a normal vector, or the like.

At step 3 (S3), the processing for changing the flat lens to a flat-shaped lens 1A is performed without changing of the reflecting surface of the temporarily set reflector obtained through the processing at step 2, so that the lens 1A has a concave shape in vertical cross section and a flat shape in transverse cross section. At this time, a light distribution pattern (not shown) of an image is obtained using through computation. More specifically, this image is created using a ray tracing method through some steps such that light from a modeled light source 2 is reflected on the reflecting surface of the reflector, the reflected light is refracted by the lens, and then the refracted light as emitted light reaches a screen frontward (not shown).

At step 4 (S4), the following processing is performed. That is, displacement between the target light distribution pattern obtained through the processing at step 2 and the light distribution pattern obtained through the processing at step 3 is computed. This displacement is produced through light refraction in the lens 1A.

At step 5 (S5) and step 6 (S6), the processing for finally setting the reflecting surface of the temporarily set reflector to the reflecting surface 4A of the reflector 3A for the lens 1A is performed so that the displacement computed through the processing at step 4 is reduced to zero. That is, the NURBS free curved surface of the reflecting surface is automatically distorted for correction to form an optimal NURBS free curved surface so that the light distribution pattern obtained through the processing at step 3 is changed to the target light distribution pattern obtained through the processing at step 2. In the respective processing at step 5 and step 6, calculation for light ray tracing is repeated using the ray tracing method such that the light from the light source 2 is reflected by the reflecting surface 4A of the reflector 3A and the reflected light is refracted by the lens 1A to reach the screen frontward (not shown) as emitted light.

At the point of time when the displacement is reduced to substantially zero, the reflecting surface 4A of the reflector 3A for the lens 1A is finally set, and at step 7 (S7), the finally set reflecting surface 4A of the reflector 3A is output.

As explained above, in this manufacturing method, the NURBS reflecting surface 4A can be manufactured when the lens 1A whose front surface and the rear surface are NURBS is used. Moreover, the processing at steps 2 to 6, that is, the step of temporarily setting the reflecting surface 4A of the reflector 3A, step of computing displacement, and step of finally setting the reflecting surface 4A of the reflector 3A are performed according to a predetermined program by the computer, and thereby the reflecting surface 4A can be manufactured with high accuracy at a high speed and with high flexibility.

The results of performing optical design simulation for the vehicle headlamp according to the first embodiment will be explained in detail below. FIG. 7A to FIG. 7D each show data to be entered to the optical design simulation. The respective data dimensions in FIG. 7A to FIG. 7D are as follows.

Ar=200 mm (lateral dimension of the reflector 3A)

Br=90 mm (longitudinal dimension of the reflector 3A)

Al=200 mm (lateral dimension of the lens 1A)

Bl=50 mm (longitudinal dimension of the lens 1A)

T=4 mm (wall thickness dimension (in the optical axis S) of the lens 1A)

Sv=0° (inclined angle (in the optical axis S) of the side face of the lens 1A)

Sh=0° (inclined angle (in the optical axis S) of the plane of the lens 1A)

Rvo=100 mm (curvature radius of the side face in the front surface of the lens 1A in the optical axis S)

Rho=800 mm (curvature radius of the plane in the front surface of the lens 1A in optical axis S)

Rvi=−200 mm (curvature radius of the side face in the rear surface of the lens 1A in the optical axis S)

Rhi=740 mm (curvature radius of the plane in the rear surface of the lens 1A in the optical axis S)

F=24 mm (focal distance)

Lf=4.6 mm (length of the filament of the light source 2)

Rf=0.73 mm (radius of the filament of the light source 2)

The respective data is entered to the following table 1 as each value. Note that the conditions are assumed to satisfy the European Light Distribution Standard ECEReg.

TABLE 1

| Reflector 3A | | |
|---|---|---|
| Width | Height | Focal distance |
| Ar (mm) | Br (mm) | F (mm) |
| 200 | 90 | 24 |

The light source 2 of the vehicle headlamp according to the first embodiment is lit to obtain the result shown in the following table 2.

TABLE 2

| | | |
|---|---|---|
| European Light Distribution Standard | | Satisfied |
| Maximum luminous intensity (cd) | | 27100 |
| Using luminous intensity (1m) | | 474 |
| Light-emitting part of the lens (mm) | Height | 50 |
| | Width | 200 |
| | Wall thickness | 4 |

Figure 9:
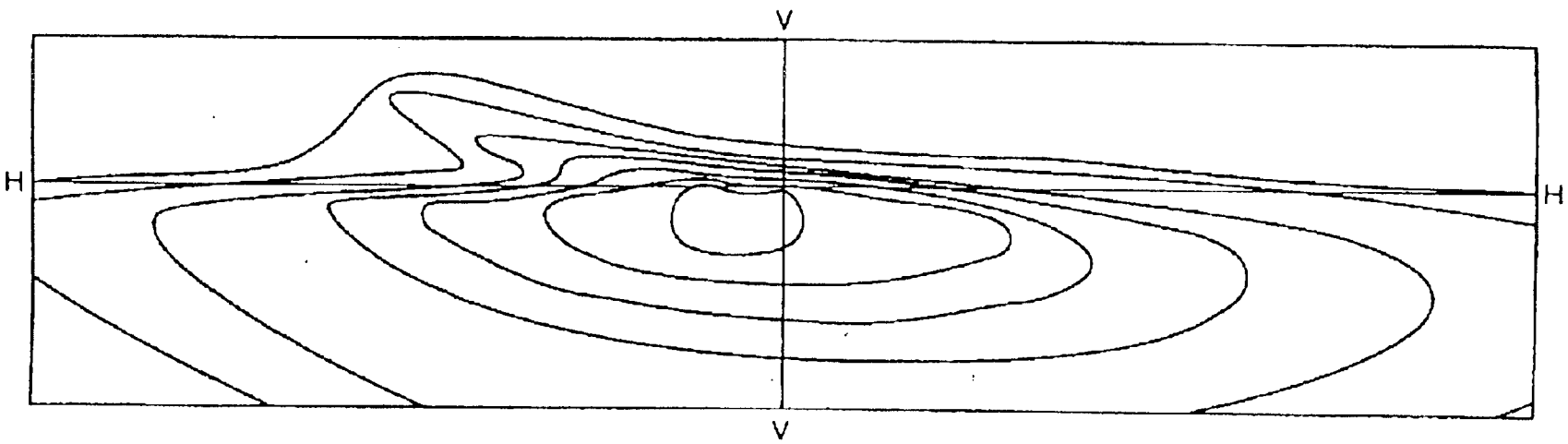
FIG. 9 is an isolux curve showing a target low-beam light distribution pattern by the vehicle headlamp according to the first embodiment.
Figure 10:
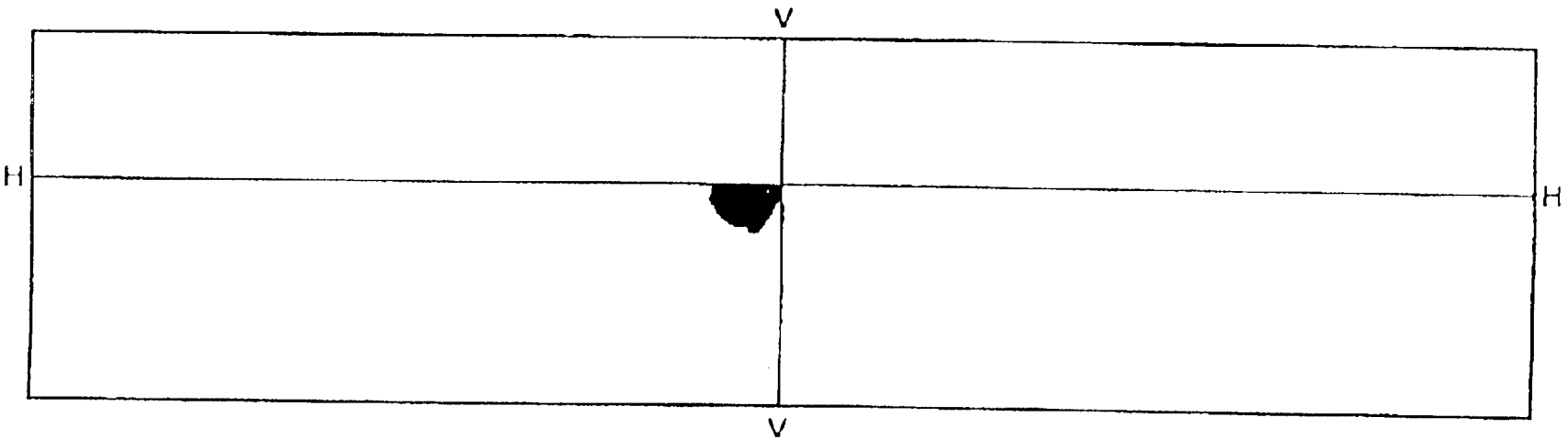
FIG. 10 shows a light distribution pattern obtained by the lens 1A shown in FIG. 1 to FIG. 4 and the reflecting surface block 21A at the first from the left of the reflecting surface 4A shown in FIG. 5, and shown by simplification of the light distribution pattern obtained through computer simulation.
Figure 11:
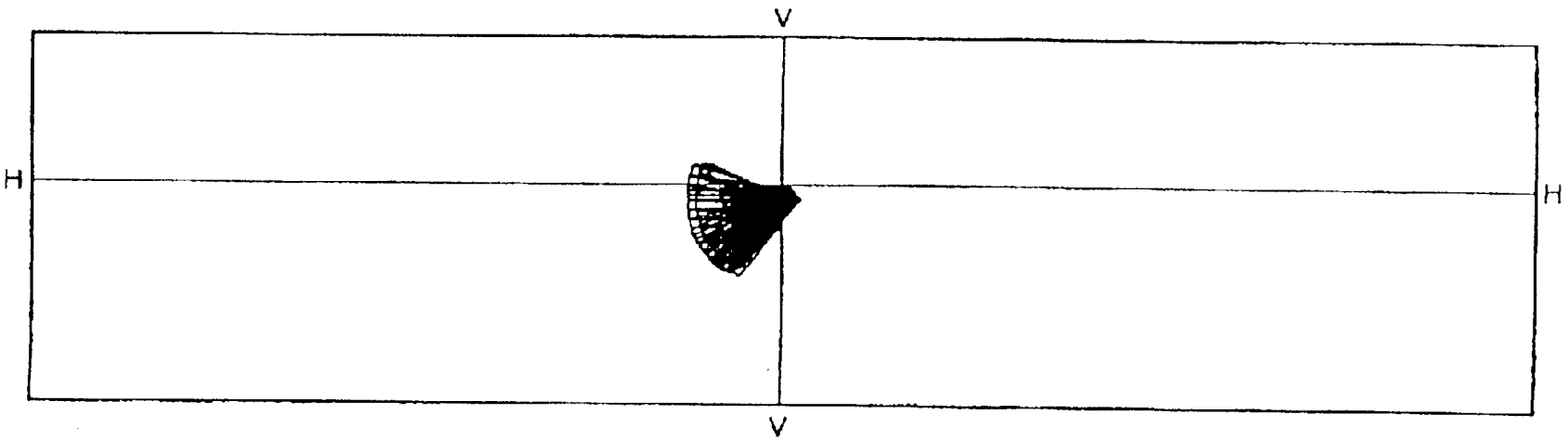
FIG. 11 shows a light distribution pattern obtained by the lens 1A shown in FIG. 1 to FIG. 4 and the reflecting surface block 22A at the second from the left of the reflecting surface 4A shown in FIG. 5, and shown by simplification of the light distribution pattern obtained through computer simulation.
Figure 12:
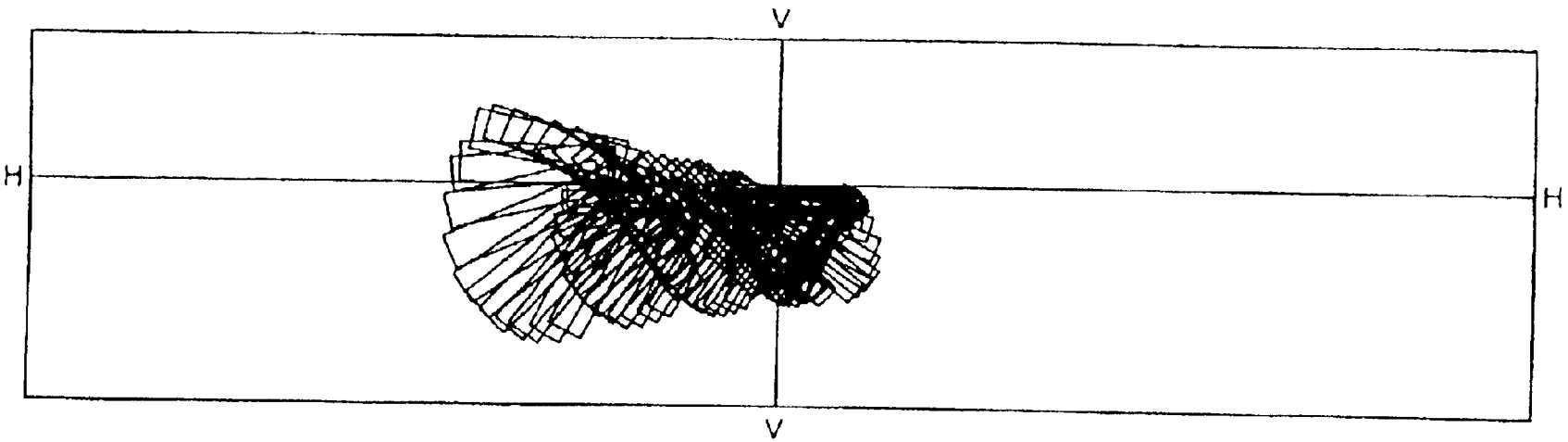
FIG. 12 shows a light distribution pattern obtained by the lens 1A shown in FIG. 1 to FIG. 4 and the reflecting surface block 23A at the third from the left of the reflecting surface 4A shown in FIG. 5, and shown by simplification of the light distribution pattern obtained through computer simulation.
Figure 13:
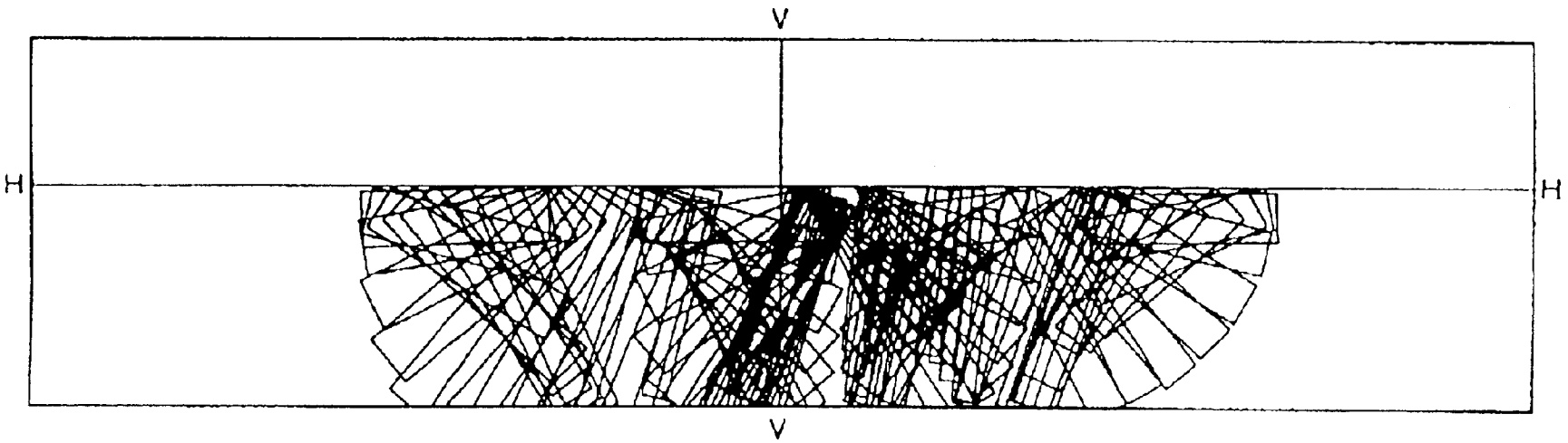
FIG. 13 shows a light distribution pattern obtained by the lens 1A shown in FIG. 1 to FIG. 4 and the reflecting surface block 24A at the fourth from the left of the reflecting surface 4A shown in FIG. 5, and shown by simplification of the light distribution pattern obtained through computer simulation.

The light source 2 of the vehicle headlamp according to the first embodiment is lit, and thereby light $L_1$ from the light source 2 is reflected by the reflecting surface 4A of the reflector 3A, as shown in FIG. 1 and FIG. 2, and the reflected light beams $L_2$ and $L_3$ pass through the lens 1A to be radiated as emitted light beams $L_4$ and $L_5$ to the outside as a target light distribution pattern as shown in FIG. 9. This target light distribution pattern refers to light distribution patterns in conformity with the European Light Distribution Standard ECEReg. or an equivalent regulation (e.g., model recognition standard for vehicles sold in Japan), North America Light Distribution Standard, FMVSS, etc.

The target light distribution pattern shown in FIG. 9 is the low-beam light distribution pattern based on left-side driving, and is controlled by the respective reflecting surface blocks 21A to 30A of the reflecting surface 4A of the reflector 3A. That is, of the reflecting surface 4A of the reflector 3A shown in FIG. 5, the reflecting surface block 21A at the first from the left controls to obtain the light distribution pattern shown in FIG. 10. The reflecting surface block 22A at the second from the left controls to obtain the light distribution pattern shown in FIG. 11. The reflecting surface block 23A at the third from the left controls to obtain the light distribution pattern shown in FIG. 12. The reflecting surface block 24A at the fourth from the left controls to obtain the light distribution pattern shown in FIG. 13. The reflecting surface block 25A at the fifth from the left controls to obtain the light distribution pattern shown in FIG. 14. The reflecting surface block 26A at the sixth from the left controls to obtain the light distribution pattern shown in FIG. 15. The reflecting surface block 27A at the seventh from the left controls to obtain the light distribution pattern shown in FIG. 16. The reflecting surface block 28A at the eighth from the left controls to obtain the light distribution pattern shown in FIG. 17. The reflecting surface block 29A at the ninth from the left controls to obtain the light distribution pattern shown in FIG. 18. The reflecting surface block 30A in the tenth from the left controls to obtain the light distribution pattern shown in FIG. 19. The light distribution patterns (FIG. 10 to FIG. 19) obtained through control of these reflecting surface blocks 21A to 30A are combined, and thereby the target light distribution pattern shown in FIG. 9 can be obtained.

As clearly seen from FIG. 10 to FIG. 19, since the reflecting blocks 21A, 22A, 29A, and 30A at the first, second, ninth, and tenth from the left are apart from the light source 2, the reflected light beams are low. Therefore, low reflected light beams are collected to form a hot zone in these reflecting blocks 21A, 22A, 29A, and 30A. Accordingly, each of the reflecting surfaces of these reflecting blocks 21A, 22A, 29A, and 30A mainly forms a concave face.

On the other hand, since the reflecting blocks 23A to 28A in the third to eighth from the left are close to the light source 2, the reflected light beams are high. Therefore, highly reflected light beams with which only a simple spot light is formed are dispersed. Accordingly, each of the reflecting surfaces of these reflecting blocks 23A to 28A mainly forms a convex face.

The reflecting surface 4A is logically designed here assuming the light source 2 as a spot light source. The actual light source 2, however, has a length and a width (radius) of the filament and is not therefore the spot light source but a surface light source as clearly seen in FIG. 1 and FIG. 2.

Figure 8A:
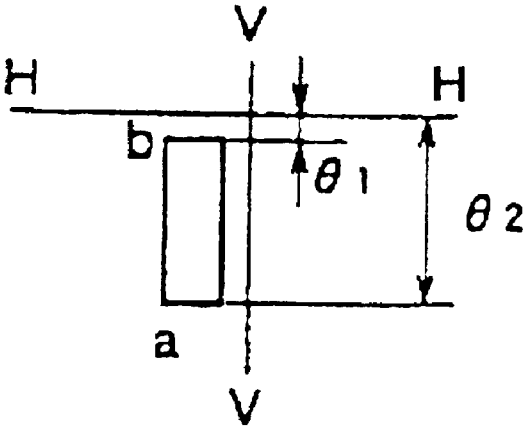
FIG. 8A shows a typical light distribution pattern formed through projection of a pin point $P_1$ in FIG. 5 to a screen.
Figure 14:
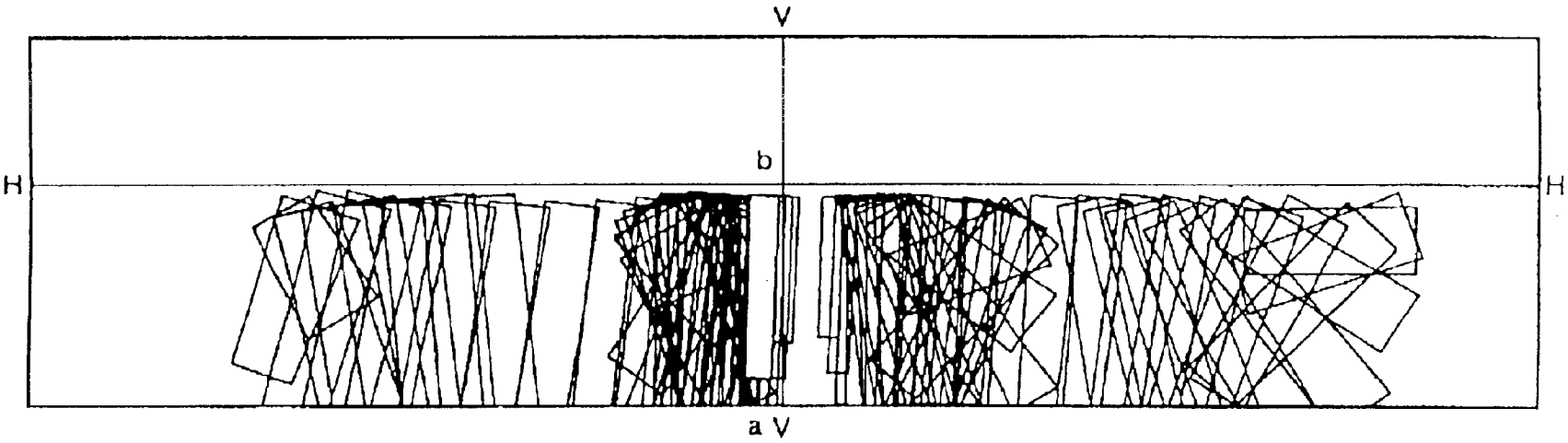
FIG. 14 shows a light distribution pattern obtained by the lens 1A shown in FIG. 1 to FIG. 4 and the reflecting surface block 25A at the fifth from the left of the reflecting surface 4A shown in FIG. 5, and shown by simplification of the light distribution pattern obtained through computer simulation.
Figure 15:
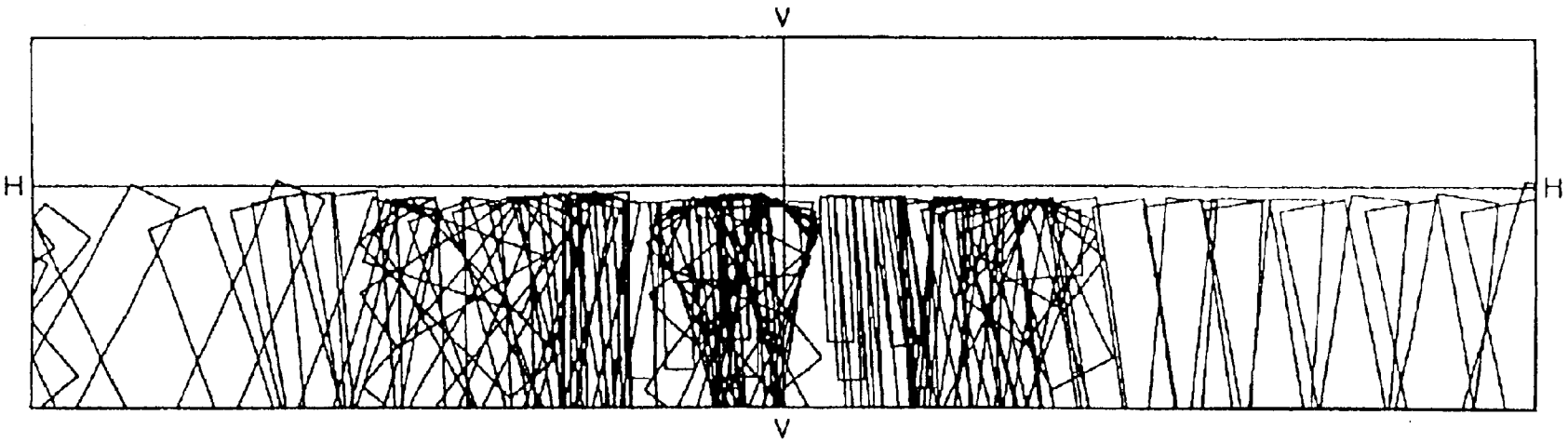
FIG. 15 shows a light distribution pattern obtained by the lens 1A shown in FIG. 1 to FIG. 4 and the reflecting surface block 26A at the sixth from the left of the reflecting surface 4A shown in FIG. 5, and shown by simplification of the light distribution pattern obtained through computer simulation.
Figure 16:
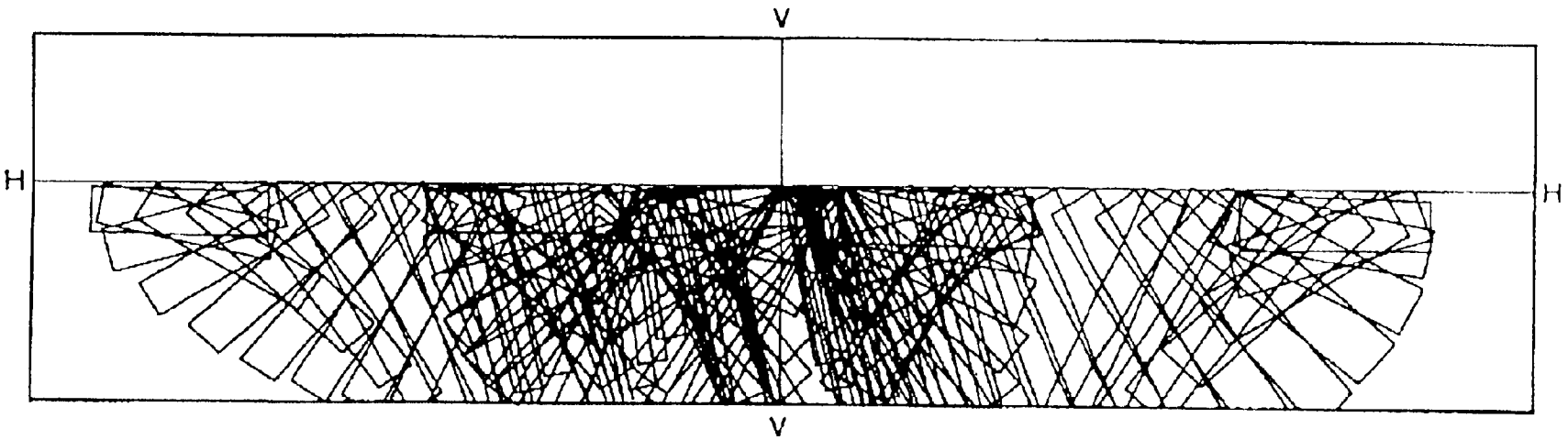
FIG. 16 shows a light distribution pattern obtained by the lens 1A shown in FIG. 1 to FIG. 4 and the reflecting surface block 27A at the seventh from the left of the reflecting surface 4A shown in FIG. 5, and shown by simplification of the light distribution pattern obtained through computer simulation.

Consequently, as shown in FIG. 5, for example, when the light of the light source 2 is reflected at a point $P_1$ of the reflecting surface 4A in the reflecting surface block 25A at the fifth from the left which is the closest to the light source 2, the light beam $L_5$ emitted from the rear end b of the light source (filament) 2 is emitted downward by an angle $\theta_1$ with respect to the horizontal line $S_1$, as shown in FIG. 1. On the other hand, the light beam $L_4$ emitted from the front end a of the light source (filament) 2 is emitted downward by an angle $\theta_2$ with respect to the horizontal line $S_1$. The emitted light beams $L_4$ and $L_5$ have longitudinally long lengths at a substantially central part on the screen as shown in FIG. 8A and FIG. 14. The angles $\theta_1$ and $\theta_2$ of the light beams $L_4$ and $L_5$ emitted from the lens 1A with respect to the horizontal line $S_1$ are, as shown in FIG. 8A, the same as angles $\theta_1$ and $\theta_2$ from the horizontal line H—H on the screen.

Figure 8B:
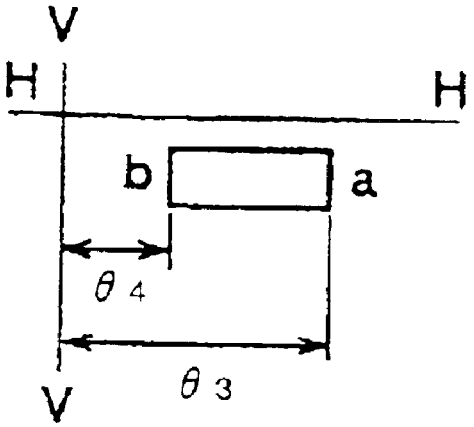
FIG. 8B shows a typical light distribution pattern formed through projection of a pin point $P_2$ in FIG. 5 to the screen.
Figure 17:
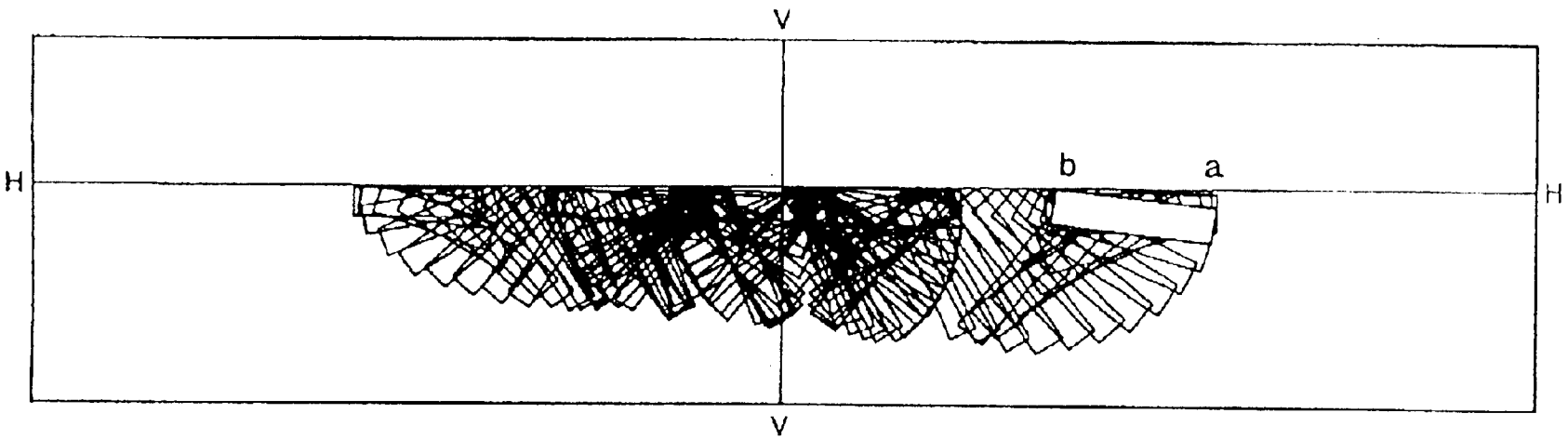
FIG. 17 shows a light distribution pattern obtained by the lens 1A shown in FIG. 1 to FIG. 4 and the reflecting surface block 28A at the eighth from the left of the reflecting surface 4A shown in FIG. 5, and shown by simplification of the light distribution pattern obtained through computer simulation.
Figure 18:
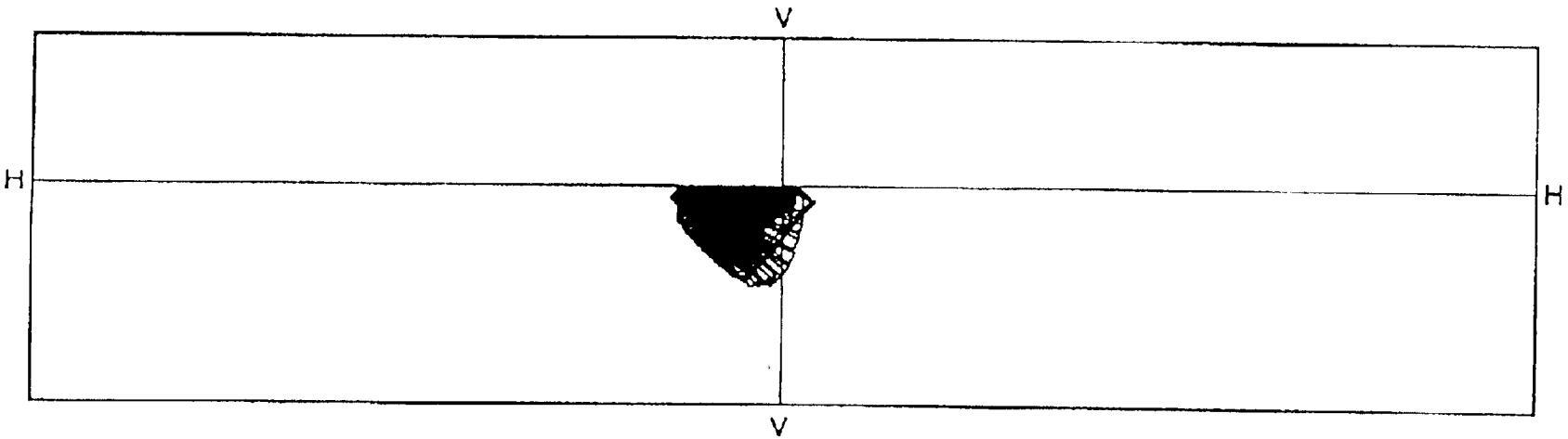
FIG. 18 shows a light distribution pattern obtained by the lens 1A shown in FIG. 1 to FIG. 4 and the reflecting surface block 29A at the ninth from the left of the reflecting surface 4A shown in FIG. 5, and shown by simplification of the light distribution pattern obtained through computer simulation.
Figure 19:
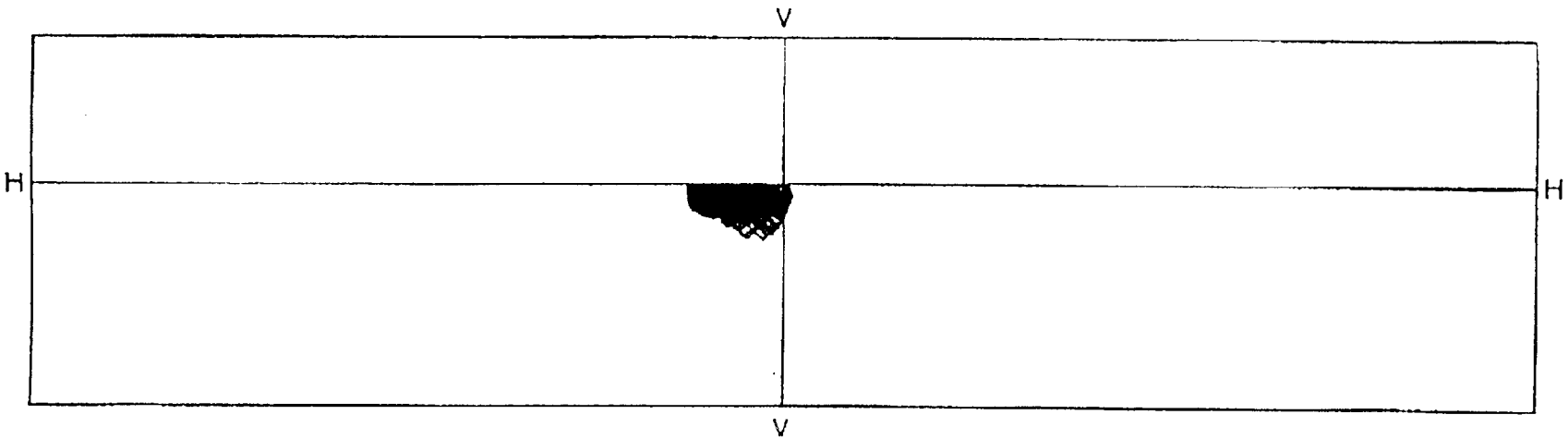
FIG. 19 shows a light distribution pattern obtained by the lens 1A shown in FIG. 1 to FIG. 4 and the reflecting surface block 30A at the tenth from the left of the reflecting surface 4A shown in FIG. 5, and shown by simplification of the light distribution pattern obtained through computer simulation.

As shown in FIG. 5, for example, when the light of the light source 2 is reflected at a point $P_2$ of the reflecting surface 4A in the reflecting surface block 28A at the eighth from the left, the light beam $L_5$ emitted from the rear end b of the light source (filament) 2 is emitted inward by an angle $\theta_4$ with respect to the vertical line $S_2$, as shown in FIG. 2. On the other hand, the light beam $L_4$ emitted from the front end a of the light source (filament) 2 is emitted inward by an angle $\theta_3$ with respect to the vertical line $S_2$. The emitted light beams $L_4$ and $L_5$ have laterally long lengths close to the horizontal line H—H on the right side of the screen as shown in FIG. 8B and FIG. 17, and is slightly inclined by the displacement in the lateral direction from the light source 2. The angles $\theta_3$ and $\theta_4$ of the light beams $L_4$ and $L_5$ emitted from the lens 1A with respect to the vertical line $S_2$ are, as shown in FIG. 8B, the same as angles $\theta_3$ and $\theta_4$ from the vertical line V—V on the screen.

As explained above, the free curved surface formed on the reflecting surface 4A is provided so that the light distribution patterns generated by the free curved surface are computer-simulated to analyze light distribution properties so as to form an optimal light distribution pattern. Therefore, when the light beams $L_2$ and $L_3$ reflected by the reflecting surface 4A pass through the lens 1A and are to be emitted to the outside, the light beams $L_4$ and $L_5$ emitted from the lens 1A form the most appropriate light distribution pattern. Moreover, in the first embodiment, the free curved surface (NURBS) is formed on the front surface and rear surface of the lens 1A, and thereby the light distribution function can be imparted not only to the reflecting surface 4A but also to the lens 1A, so that a more ideal light distribution pattern can be obtained.

Particularly, the vehicle headlamp according to the first embodiment has the lens 1A with a concave shape in vertical cross section, and thereby even if the prism is not formed thereon, light is largely refracted by the lens 1A and the interior is harder to be seen from the outside. Consequently, the vehicle headlamp of the first embodiment does not require giving a finish more than optical performance required for reflection to the front surface of the reflecting surface 4A of the reflector 3A, which is for the purpose of enhancement of its appearance, thus the machining work is easier than the conventional work.

Further, the vehicle headlamp according to the first embodiment has the lens 1A with a flat shape in transverse cross section, and thereby the lens 1A can be easily polished when the lens 1A is made of glass, which is excellent in manufacture of the lens 1A.

Figure 3:
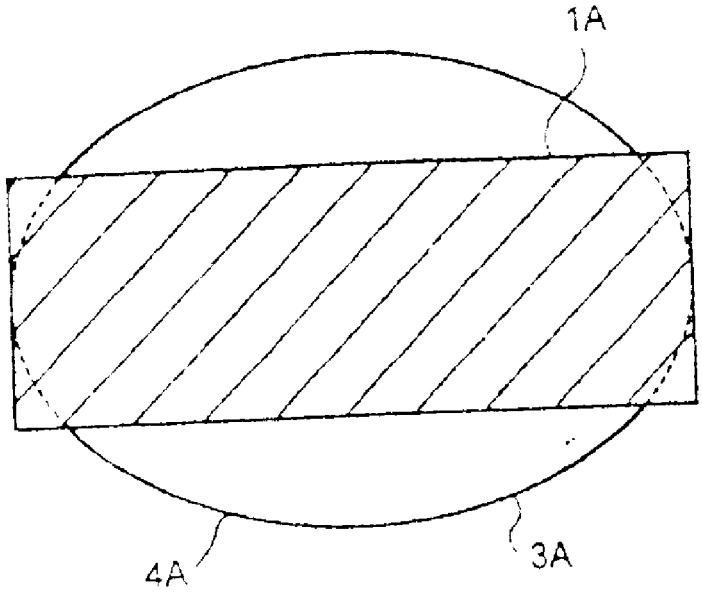
FIG. 3 is its front view.
Figure 4:
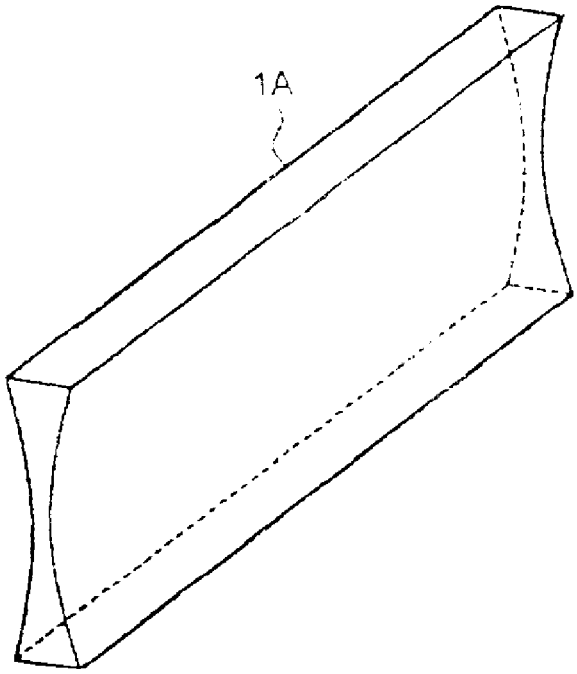
FIG. 4 is a perspective view of the lens.

The lens 1A according to the first embodiment has a concave shape in vertical cross section and a flat shape in transverse cross section. Therefore, in the vertical cross section of the lens 1A, as shown in FIG. 1, the light beams $L_2$ and $L_3$ converged by the substantially ellipsoidal surface of the reflecting surface 4A are dispersed in the direction substantially along the optical axis S. While in the transverse cross section of the lens 1A, as shown in FIG. 2, the light beams $L_2$ and $L_3$ reflected by the substantially paraboloidal surface of the reflecting surface 4A pass through the lens as they are in the direction substantially along the optical axis S, and are emitted to the outside as the target light distribution pattern. As a result, the first embodiment provides the vehicle headlamp using the lens 1A with a laterally elongated shape when viewed from the front side as shown in FIG. 3. Accordingly, the first embodiment is right fit for car body design in a case where the front section cannot afford to keep sufficient room for installation of the vehicle headlamps in longitudinal dimensions.

Further, the reflecting surface 4A of the first embodiment is a substantially ellipsoidal surface in vertical cross section, which is larger than the lens 1A, and is a substantially paraboloidal surface in transverse cross section, which is almost the same size as that of the lens 1A. Therefore, in the vertical cross section of the reflecting surface 4A, as shown in FIG. 1, the light beams $L_2$ and $L_3$ can be led to the lens 1A while being kept vertically converged substantially along the optical axis S. Further, in the transverse cross section of the reflecting surface 4A, as shown in FIG. 2, the light beams $L_2$ and $L_3$ can be led to the lens 1A while being kept substantially along the optical axis S. As a result, the first embodiment is the most suitable for a combination with the lens 1A having a concave shape in vertical cross section and a flat shape in transverse cross section. As shown in FIG. 3, the vehicle headlamp whose front surface (the surface of the lens 1A) is longitudinally short and laterally long can easily be obtained. Furthermore, light is converged in a broad range by the substantially ellipsoidal surface that is larger than the lens 1A to be reflected to the side of the lens 1A in the vertical direction of the reflecting surface 4A, and therefore there is no problem in terms of an optical amount.

Figure 20A:
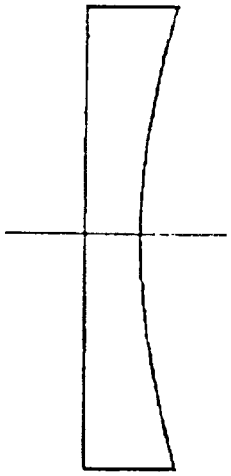
FIG. 20A, FIG. 20B, and FIG. 20C are cross-sectional views showing modified examples of the concave shape of the lens in cross section.
Figure 20B:
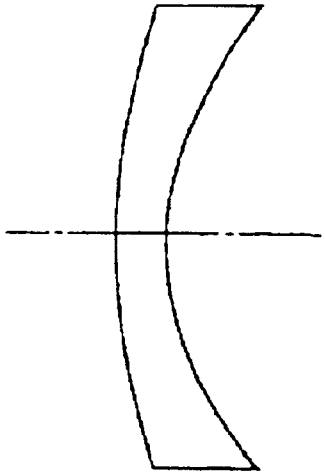
Figure 20C:
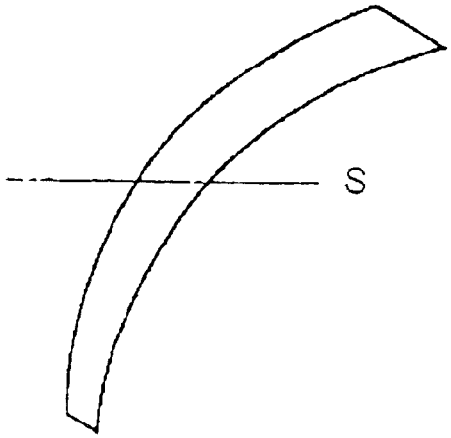

In the first embodiment, the concave shape of the lens 1A in vertical cross section here indicates a shape having an optical function that refracts an incident light in a direction in which the light is separated (dispersed) from the optical axis S in the vertical cross section of the lens 1A. Therefore, the concave shape includes a shape having a concave shape only in one side as shown in FIG. 20A, a shape having a convex shape in one side and a concave shape in the other side whose degree of curve is greater than that of the convex shape as shown in FIG. 20B, and a shape inclined with respect to the optical axis S as shown in FIG. 20C.

FIG. 21 to FIG. 34 show a second embodiment. In the figures, the same legends as these in FIG. 1 to FIG. 20 represent the same sections.

The vehicle headlamp according to the second embodiment comprises the lens 1B, light source 2, and the reflector 3B.

The lens 1B, as shown in FIG. 21 to FIG. 24, has an outside shape of a longitudinally elongated rectangle when viewed from the front side, a flat shape in vertical cross section, and a concave shape in transverse cross section. The lens 1B is formed like the lens 1A of the first embodiment. That is, the lens 1B is not provided with a prism for light distribution. NURBS as a free curved surface for light distribution is formed on the front surface and the rear surface of the lens 1B.

Figure 21:
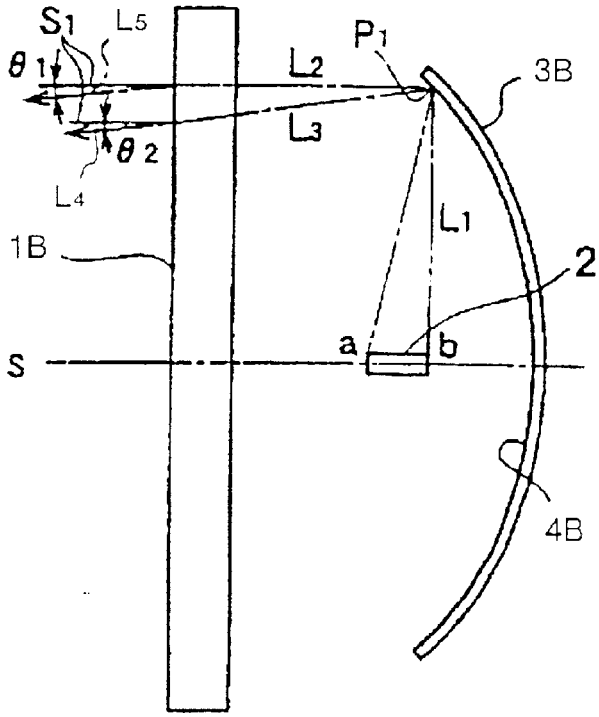
FIG. 21 is a vertical sectional view schematically showing a vehicle headlamp according to a second embodiment of this invention.
Figure 25:
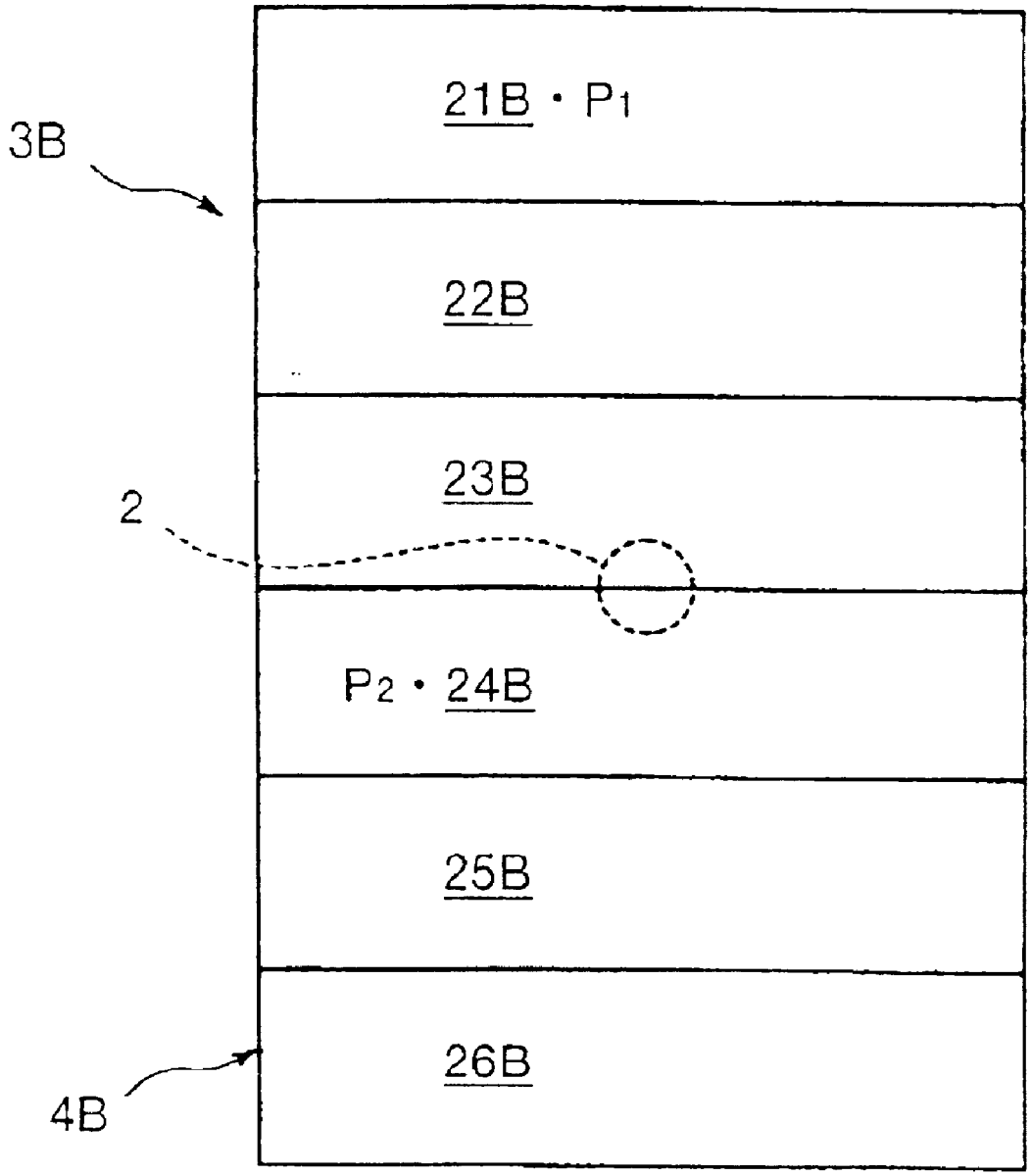
FIG. 25 is a front view of the reflecting surface.
Figure 26B:
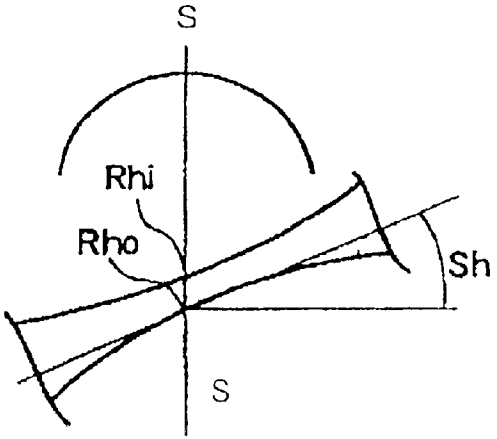
FIG. 26B is a cross-sectional view taken along the line B—B in FIG. 26A.
Figure 26A:
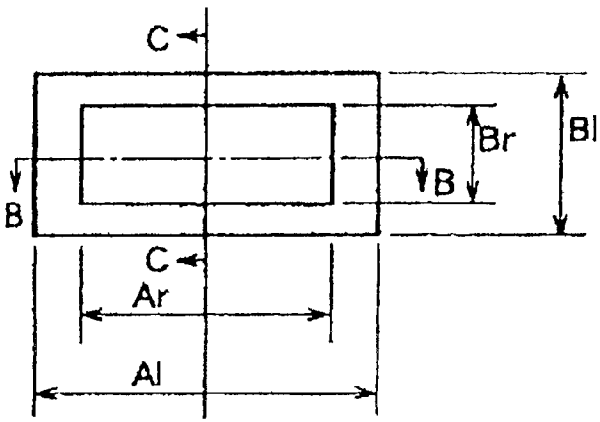
FIG. 26A is a front view for explaining data to be input to optical simulation.
Figure 26C:
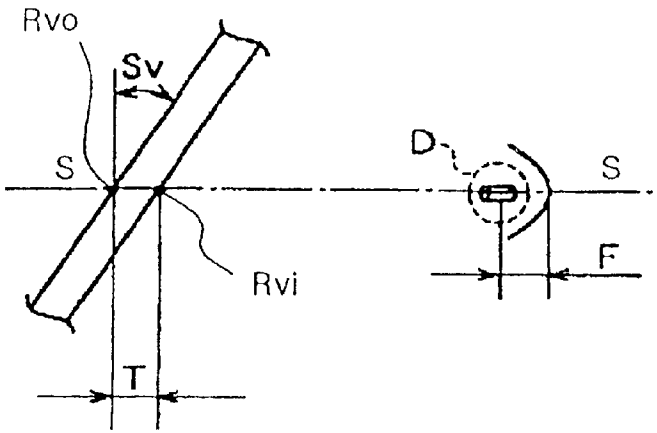
FIG. 26C is a cross-sectional view taken along the line C—C in FIG. 26A.
Figure 26D:
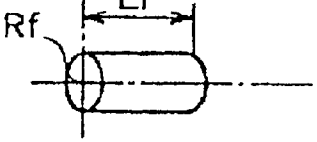
FIG. 26D is an enlarged view of the D portion in FIG. 26C.

The internal surface of the reflector 3B is provided with a reflecting surface 4B such as NURBS as a free curved surface for light distribution. The reflecting surface 4B is formed corresponding to the lens 1B like the reflecting surface 4A of the first embodiment. As shown in FIG. 21, this reflecting surface 4B is a substantially paraboloidal surface in vertical cross section, which is almost the same size as the lens 1B, and is a substantially ellipsoidal surface in transverse cross section, which is larger than the lens 1B. As an example of this reflecting surface 4B, the surface is laterally divided into six blocks as shown in FIG. 25.

Boundaries of the 6-divided reflecting surface blocks 21B, 22B, 23B, 24B, 25B, and 26B are sometimes visible independently from each other and sometimes not.

The reflecting blocks of the reflecting surface 4B may include those obtained through division of the surface in the longitudinal direction, other than the lateral direction, in the parabolic direction, and in any directions as a combination of the longitudinal direction, lateral direction, and parabolic direction, if necessary. That is, the reflecting surface is divided into blocks in terms of design.

The manufacturing method of the reflecting surface 4B is performed in the same manner as that of the reflecting surface 4A of the first embodiment.

The results of performing optical design simulation for the vehicle headlamp according to the second embodiment will be explained in detail below. FIG. 26A to FIG. 26D each show data to be entered to the optical design simulation. The respective data dimensions in FIG. 26A to FIG. 26D are as follows.

Ar=60 mm (lateral dimension of the reflector 3B)

Br=120 mm (longitudinal dimension of the reflector 3B)

Al=100 mm (lateral dimension of the lens 1B)

Bl=120 mm (longitudinal dimension of the lens 1B)

T=4 mm (wall thickness dimension (in the optical axis S) of the lens 1B)

Sv=0° (inclined angle (in the optical axis S) of the side face of the lens 1B)

Sh=0° (inclined angle (in the optical axis S) of the plane of the lens 1B)

Rvo=1400 mm (curvature radius of the side face in the front surface of the lens 1B in the optical axis S)

Rho=1400 mm (curvature radius of the plane in the front surface of the lens 1B in the optical axis S)

Rvi=1400 mm (curvature radius of the side face in the rear surface of the lens 1B in the optical axis S)

Rhi=−200 mm (curvature radius of the plane in the rear surface of the lens 1B in the optical axis S)

F=22 mm (focal distance)

Lf=4.6 mm (length of the filament of the light source 2)

Rf=0.73 mm (radius of the filament of the light source 2)

The respective data is entered to the following table 3 as each value. Note that the conditions are assumed to satisfy the European Light Distribution Standard ECEReg.

TABLE 3

| Reflector 3B | | |
|---|---|---|
| Width | Height | Focal distance |
| Ar (mm) | Br (mm) | F (mm) |
| 60 | 120 | 22 |

The light source 2 of the vehicle headlamp according to the second embodiment is lit to obtain the result shown in the following table 4.

TABLE 4

| | | |
|---|---|---|
| European Light Distribution Standard | | Satisfied |
| Maximum luminous intensity (cd) | | 18530 |
| Using luminous intensity (1m) | | 375 |
| Light-emitting part of the lens (mm) | Height | 120 |
| | Width | 100 |
| | Wall thickness | 4 |

Figure 28:
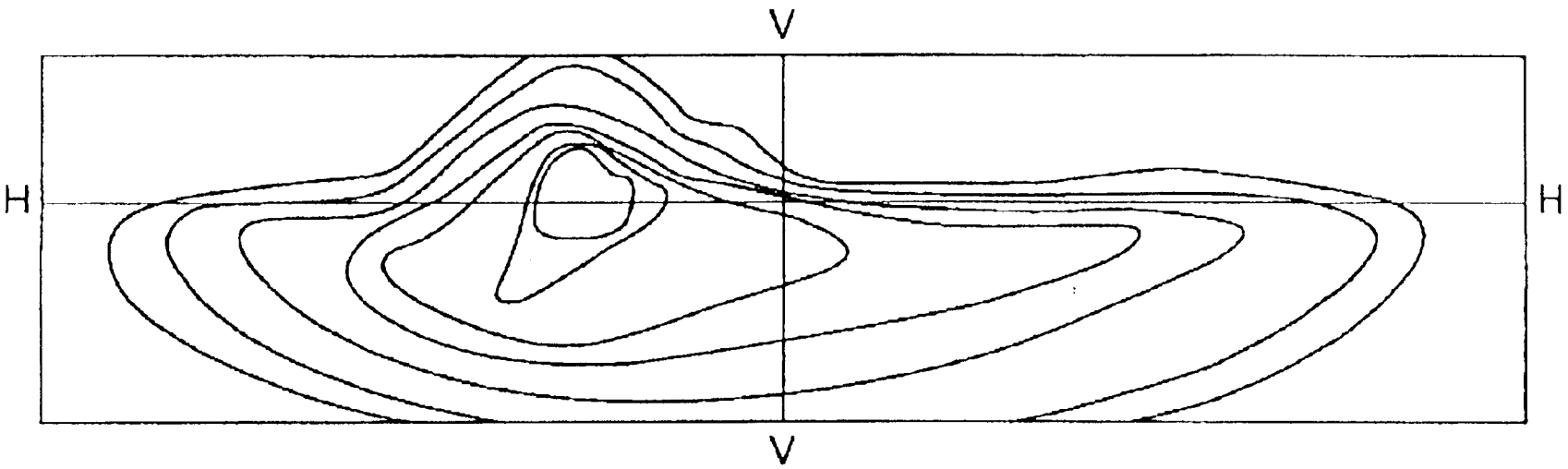
FIG. 28 is an isolux curve showing a target low-beam light distribution pattern by the vehicle headlamp according to the second embodiment.

The light source 2 of the vehicle headlamp according to the second embodiment is lit and thereby a target light distribution pattern as shown in FIG. 28 is obtained.

The target light distribution pattern shown in FIG. 28 is the low-beam light distribution pattern based on left-side driving, and is controlled by the respective reflecting surface blocks 21B to 26B of the reflecting surface 4B of the reflector 3B. That is, of the reflecting surface 4B of the reflector 3B shown in FIG. 25, the reflecting surface block 21B at the first from the top controls to obtain the light distribution pattern shown in FIG. 29. The reflecting surface block 22B at the second from the top controls to obtain the light distribution pattern shown in FIG. 30. The reflecting surface block 23B at the third from the top controls to obtain the light distribution pattern shown in FIG. 31. The reflecting surface block 24B at the fourth from the top controls to obtain the light distribution pattern shown in FIG. 32. The reflecting surface block 25B at the fifth from the top controls to obtain the light distribution pattern shown in FIG. 33. The reflecting surface block 26B at the sixth from the top controls to obtain the light distribution pattern shown in FIG. 34. The light distribution patterns (FIG. 29 to FIG. 34) obtained through control of these reflecting surface blocks 21B to 26B are combined, and thereby the target light distribution pattern shown in FIG. 28 can be obtained.

As clearly seen from FIG. 29 to FIG. 34, the reflecting blocks 21B, 22B, 23B, and 26B at the first, second, third, and sixth from the top disperse reflected light beams. Therefore, each of respective reflecting surfaces of these reflecting blocks 21B, 22B, 23B, and 26B mainly forms a convex face. While the reflecting blocks 24B and 25B at the forth and fifth from the top converge the reflected light beams to form a hot zone. Therefore, each of the reflecting surfaces of these reflecting blocks 24B and 25B mainly forms a concave face.

The reflecting surface 4B is logically designed here assuming the light source 2 as a spot light source. The actual light source 2, however, has a length and a width (radius) of the filament and is not therefore the spot light source but a surface light source as clearly seen in FIG. 21 and FIG. 22.

Figure 27A:
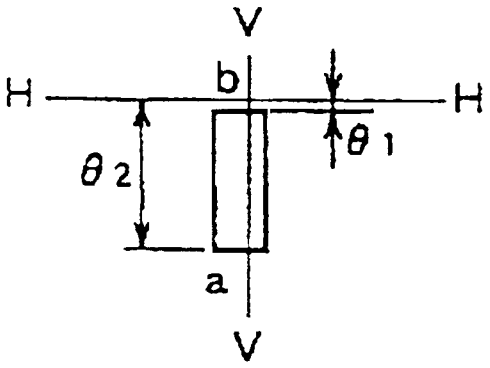
FIG. 27A shows a typical light distribution pattern formed through projection of a pin point $P_1$ in FIG. 25 projected to the screen.
Figure 29:
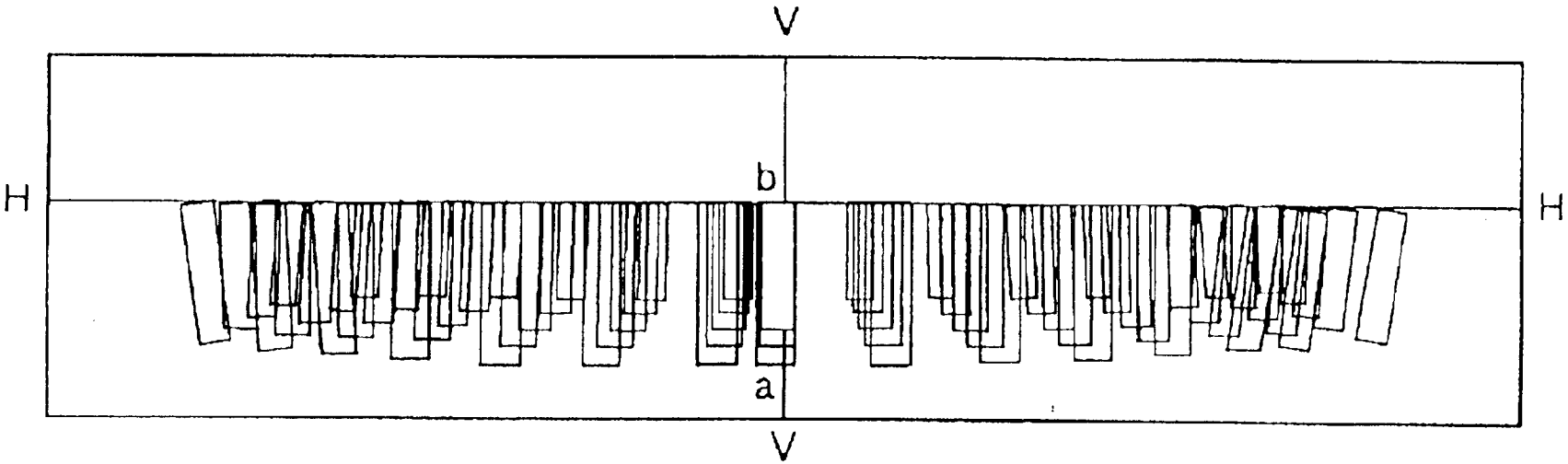
FIG. 29 shows a light distribution pattern obtained by the lens 1B shown in FIG. 21 to FIG. 24 and the reflecting surface block 21B at the first from the top of the reflecting surface 4B shown in FIG. 25, and shown by simplification of the light distribution pattern obtained through computer simulation.
Figure 30:
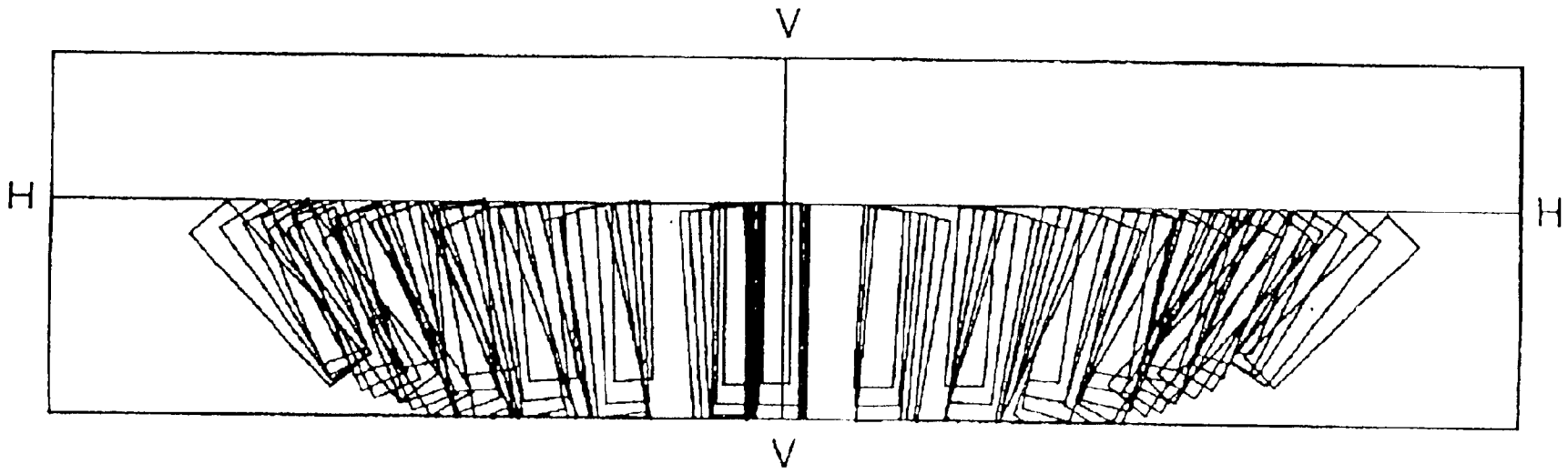
FIG. 30 shows a light distribution pattern obtained by the lens 1B shown in FIG. 21 to FIG. 24 and the reflecting surface block 22B at the second from the top of the reflecting surface 4B shown in FIG. 25, and shown by simplification of the light distribution pattern obtained through computer simulation.
Figure 31:
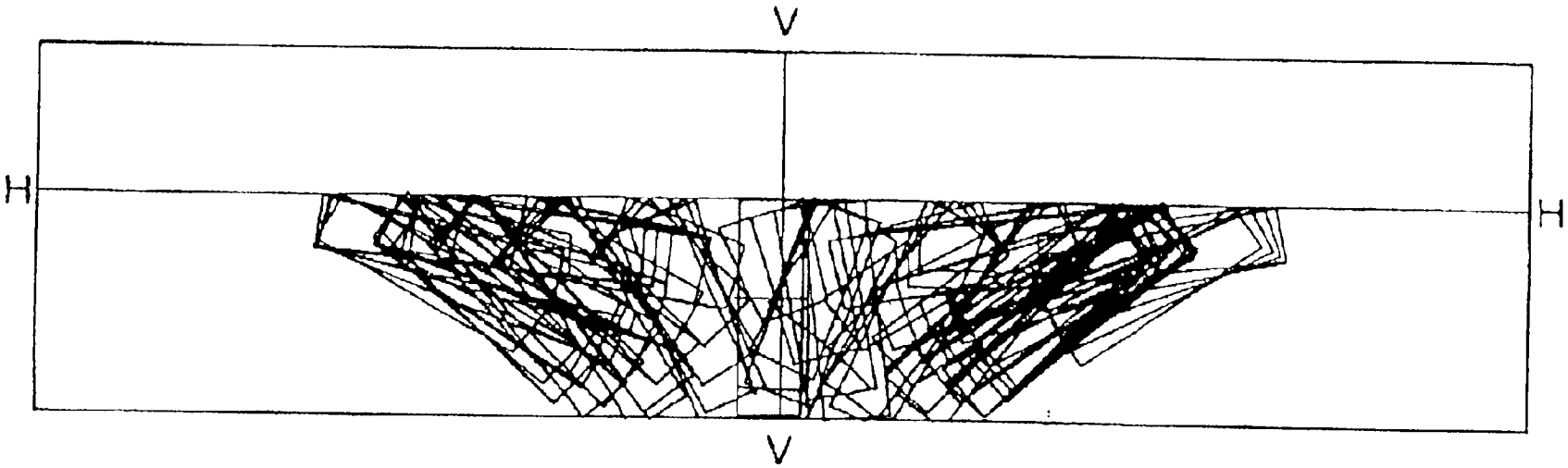
FIG. 31 shows a light distribution pattern obtained by the lens 1B shown in FIG. 21 to FIG. 24 and the reflecting surface block 23B at the third from the top of the reflecting surface 4B shown in FIG. 25, and shown by simplification of the light distribution pattern obtained through computer simulation.

Therefore, as shown in FIG. 25, for example, when the light of the light source 2 is reflected at a point $P_1$ in the reflecting surface block 21B at the first from the top, the light beam $L_5$ emitted from the rear end b of the light source (filament) 2 is emitted downward by an angle $\theta_1$ with respect to the horizontal line $S_1$, as shown in FIG. 21. On the other hand, the light beam $L_4$ emitted from the front end a of the light source (filament) 2 is emitted downward by an angle $\theta_2$ with respect to the horizontal line $S_1$. The emitted light beams $L_4$ and $L_5$ have longitudinally long lengths at a substantially central part on the screen as shown in FIG. 27A and FIG. 29. The angles $\theta_1$ and $\theta_2$ of the light beams $L_4$ and $L_5$ emitted from the lens 1B with respect to the horizontal line $S_1$ are, as shown in FIG. 27A, the same as angles $\theta_1$ and $\theta_2$ from the horizontal line H—H on the screen.

Figure 22:
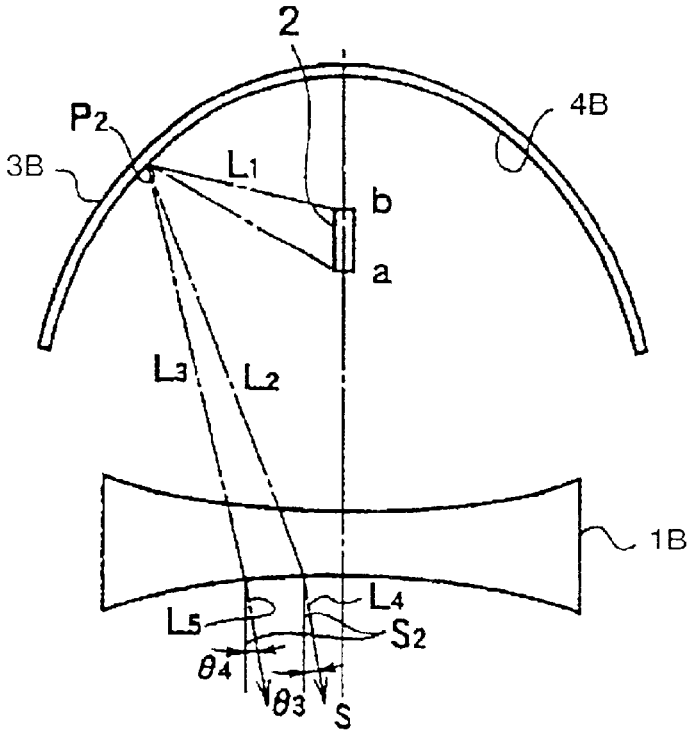
FIG. 22 is its transverse sectional view.
Figure 27B:
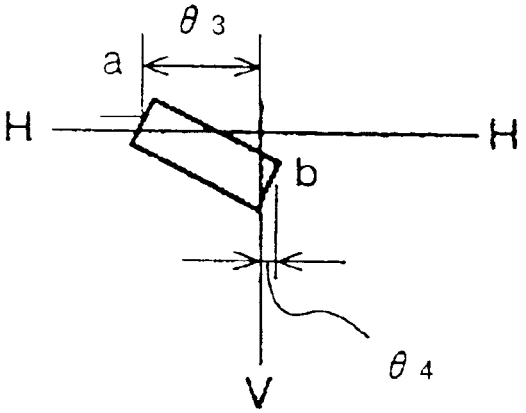
FIG. 27B shows a typical light distribution pattern formed through projection of a pin point $P_2$ in FIG. 25 to the screen.
Figure 32:
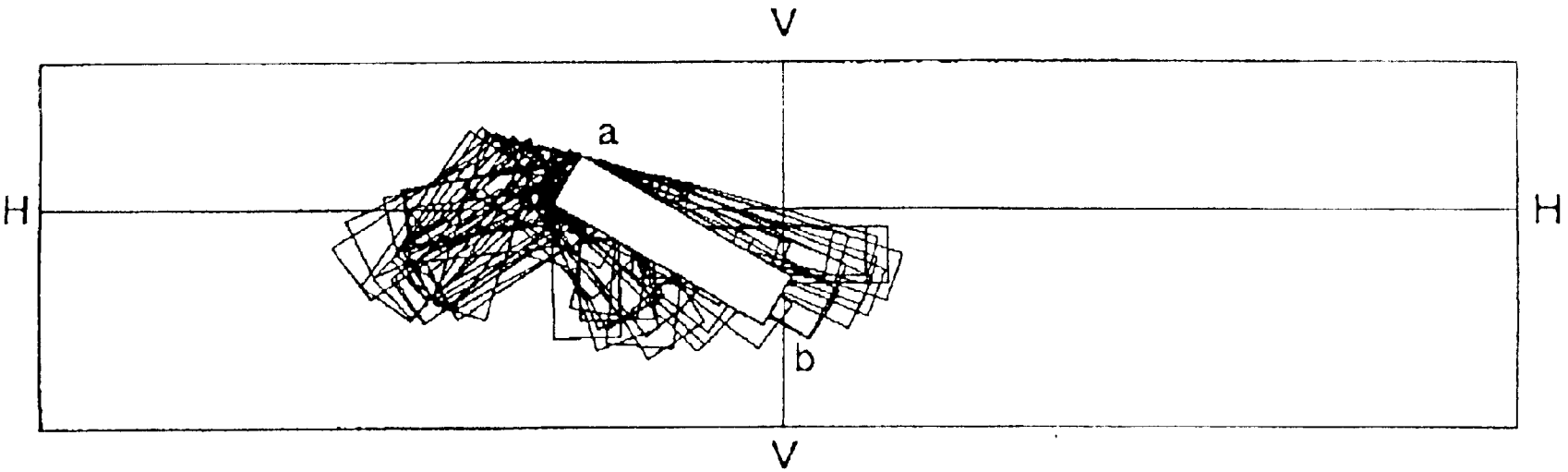
FIG. 32 shows a light distribution pattern obtained by the lens 1B shown in FIG. 21 to FIG. 24 and the reflecting surface block 24B at the fourth from the top of the reflecting surface 4B shown in FIG. 25, and shown by simplification of the light distribution pattern obtained through computer simulation.
Figure 33:
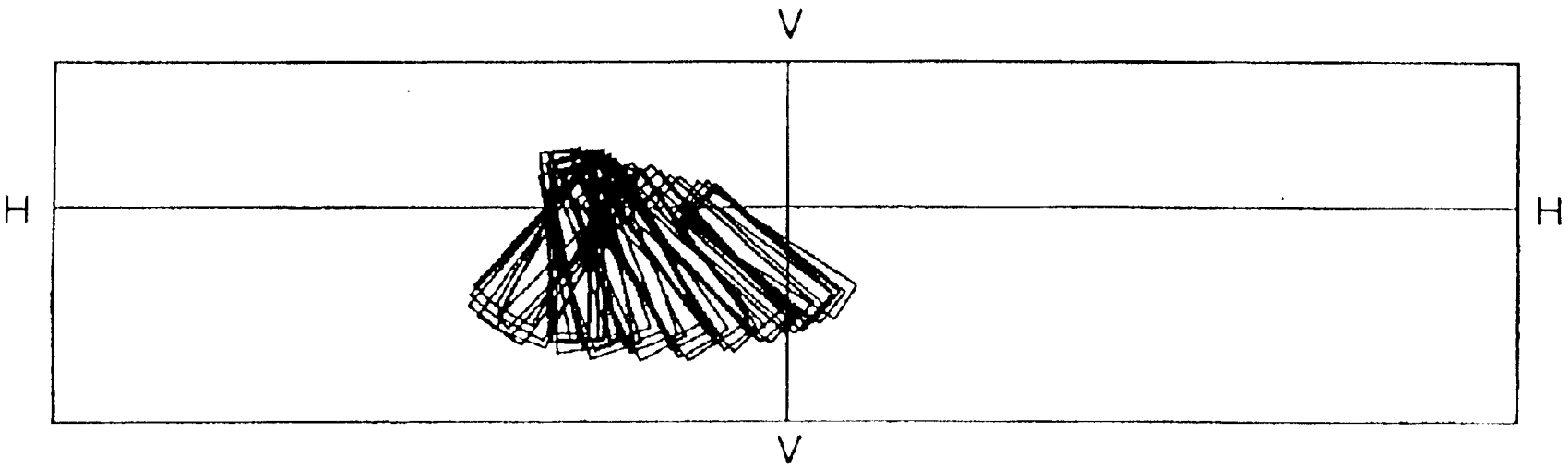
FIG. 33 shows a light distribution pattern obtained by the lens 1B shown in FIG. 21 to FIG. 24 and the reflecting surface block 25B at the fifth from the top of the reflecting surface 4B shown in FIG. 25, and shown by simplification of the light distribution pattern obtained through computer simulation.
Figure 34:
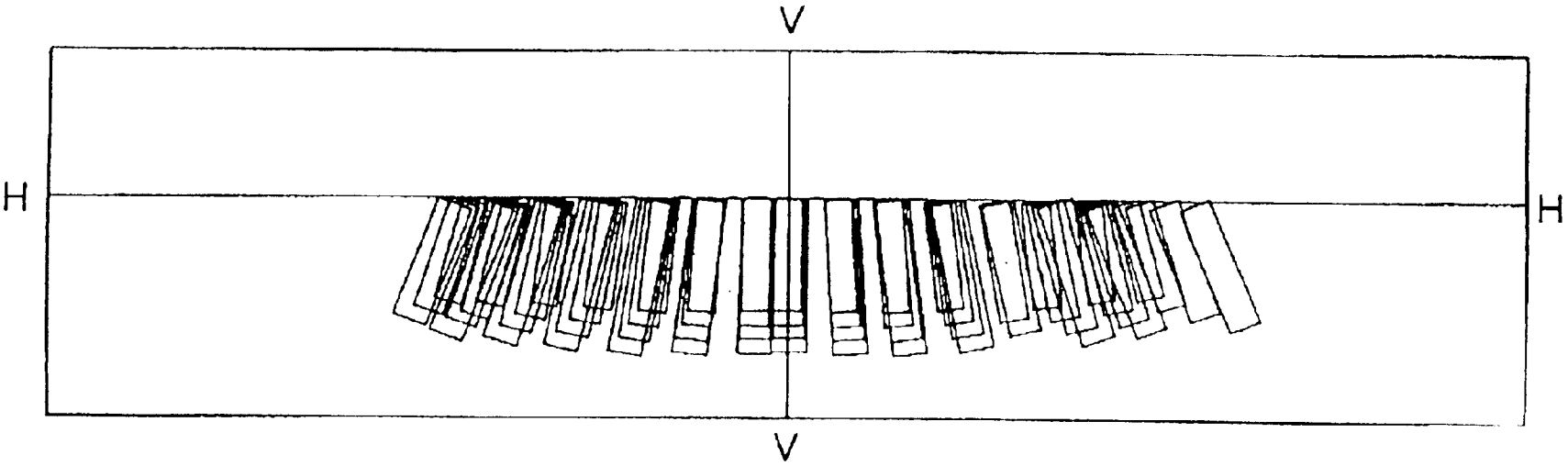
FIG. 34 shows a light distribution pattern obtained by the lens 1B shown in FIG. 21 to FIG. 24 and the reflecting surface block 26B at the sixth from the top of the reflecting surface 4B shown in FIG. 25, and shown by simplification of the light distribution pattern obtained through computer simulation.

As shown in FIG. 25, for example, when the light of the light source 2 is reflected at a point $P_2$ in the reflecting surface block 24B at the fourth from the top, the light beam $L_5$ emitted from the rear end b of the light source (filament) 2 is emitted inward by an angle $\theta_4$ with respect to the vertical line $S_2$, as shown in FIG. 22. On the other hand, the light beam $L_4$ emitted from the front end a of the light source (filament) 2 is emitted inward by an angle $\theta_3$ with respect to the vertical line $S_2$. The emitted light beams $L_4$ and $L_5$ have laterally long lengths close to the left hand side of the substantially central part of the screen as shown in FIG. 27B and FIG. 32, and is slightly inclined by the displacement in the lateral direction from the light source 2. The angles $\theta_3$ and $\theta_4$ of the light beams $L_4$ and $L_5$ emitted from the lens 1B with respect to the vertical line $S_2$ are, as shown in FIG.

27B, the same as angles $\theta_3$ and $\theta_4$ from the vertical line V—V on the screen.

As explained above, the free curved surface formed on the reflecting surface 4B is provided so that the light distribution patterns generated by the free curved surface are computer-simulated to analyze light distribution properties so as to form an optimal light distribution pattern. Therefore, when the light beams $L_2$ and $L_3$ reflected by the reflecting surface 4B pass through the lens 1B and are to be emitted to the outside, the light beams $L_4$ and $L_5$ emitted from the lens 1B form the most appropriate light distribution pattern. Moreover, in the second embodiment, the free curved surface (NURBS) is formed on the front surface and rear surface of the lens 1B, and thereby the light distribution function can be imparted not only to the reflecting surface 4B but also to the lens 1B, so that a more ideal light distribution pattern can be obtained.

Particularly, the vehicle headlamp according to the second embodiment has the lens 1B with a concave shape in transverse cross section, and thereby even if the prism is not formed thereon, light is largely refracted by the lens 1B and the interior is harder to be seen from the outside. Consequently, the vehicle headlamp of the second embodiment does not require giving a finish more than optical performance required for reflection to the front surface of the reflecting surface 4B of the reflector 3B, which is for the purpose of enhancement of its appearance, thus the machining work is easier than the conventional work.

Further, the vehicle headlamp according to the second embodiment has the lens 1B with a flat shape in vertical cross section, and therefore the lens 1B can be easily polished when it is made of glass, which is excellent in manufacture of the lens 1B.

Figure 23:
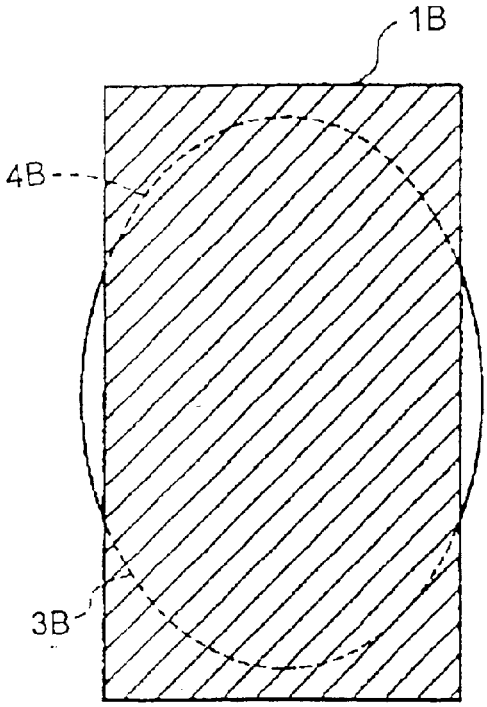
FIG. 23 is its front view.
Figure 24:
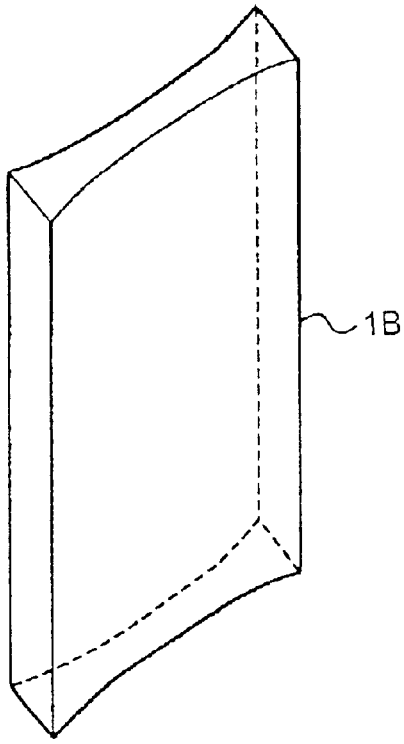
FIG. 24 is a perspective view of the lens.

The lens 1B of the first embodiment has a flat shape in vertical cross section and a concave shape in transverse cross section. Therefore, in the vertical cross section of the lens 1B, as shown in FIG. 21, the light beams $L_2$ and $L_3$ reflected by the substantially paraboloidal surface of the reflecting surface 4B pass through the lens 1B as they are in the direction substantially along the optical axis S. While in the transverse cross section of the lens 1B, as shown in FIG. 22, the light beams $L_2$ and $L_3$ converged by the substantially ellipsoidal surface of the reflecting surface 4B are dispersed in the direction substantially along the optical axis S and emitted to the outside as the target light distribution pattern. As a result, the second embodiment provides the vehicle headlamp using the lens 1B with a longitudinally elongated shape when viewed from the front side as shown in FIG. 23. Therefore, the second embodiment is right fit for car body design in a case where the front section cannot afford to keep sufficient room for installation of the vehicle headlamp in lateral dimensions.

Further, the reflecting surface 4B of the second embodiment is a substantially paraboloidal surface in vertical cross section, which is almost the same size as the lens 1B, and is a substantially ellipsoidal surface in transverse cross section, which is larger than the lens 1B. Therefore, in the vertical cross section of the reflecting surface 4B, as shown in FIG. 21, the light beams $L_2$ and $L_3$ can be led to the lens 1B while being kept substantially along the optical axis S. Further, in the transverse cross section of the reflecting surface 4B, as shown in FIG. 22, the light beams $L_2$ and $L_3$ can be led to the lens 1B while being kept laterally converged substantially along the optical axis S. As a result, the second embodiment is the most suitable for a combination with the lens 1B having a flat shape in vertical cross section and a concave shape in transverse cross section. As shown in FIG. 23, the vehicle headlamp whose front surface (the surface of the lens 1B) is longitudinally long and laterally short can easily be obtained. Furthermore, light is converged in a broad range by the substantially ellipsoidal surface that is larger than the lens 1B to be reflected to the side of the lens 1B in the lateral direction of the reflecting surface 4B and therefore there is no problem in terms of an optical amount.

In the second embodiment, the concave shape of the lens 1A in transverse cross section here indicates a shape having an optical function that refracts an incident light in a direction in which the light is separated (dispersed) from the optical axis S in the transverse cross section of the lens 1B. Therefore, the concave shape includes a shape having a concave shape only in one side as shown in FIG. 20A, a shape having a convex shape in one side and a concave shape in the other side whose degree of curve is greater than that of the convex shape as shown in FIG. 20B, and a shape inclined with respect to the optical axis S as shown in FIG. 20C.

FIG. 35 to FIG. 49 show a third embodiment. In the figures, the same legends as these in FIG. 1 to FIG. 34 represent the same sections.

The vehicle headlamp according to the third embodiment comprises the lens 1C, light source 2, and the reflector 3.

The lens 1C, as shown in FIG. 35 to FIG. 38, has an outside shape of a longitudinally elongated rectangle when viewed from the front side, a convex shape in vertical cross section, and a flat shape in transverse cross section. The lens 1C is formed like the lenses 1A and 1B of the first and second embodiments. That is, the lens 1C is not provided with a prism for light distribution. NURBS as a free curved surface for light distribution is formed on the front surface and the rear surface of the lens 1C.

Figure 35:
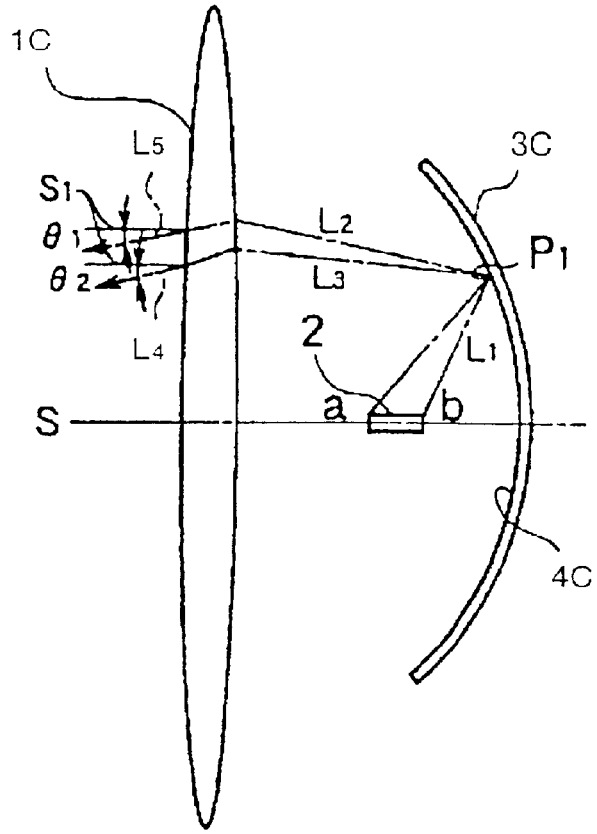
FIG. 35 is a vertical sectional view schematically showing a vehicle headlamp according to a third embodiment of this invention.
Figure 36:
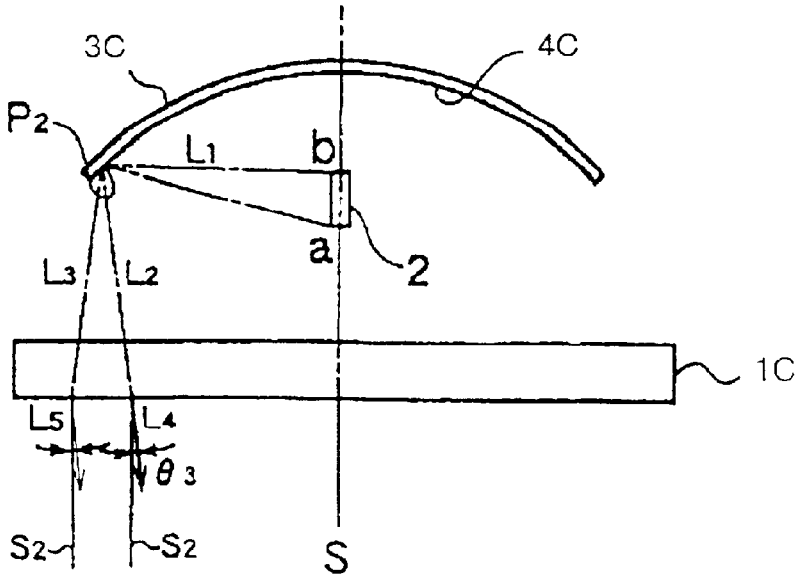
FIG. 36 is its transverse sectional view.
Figure 39:
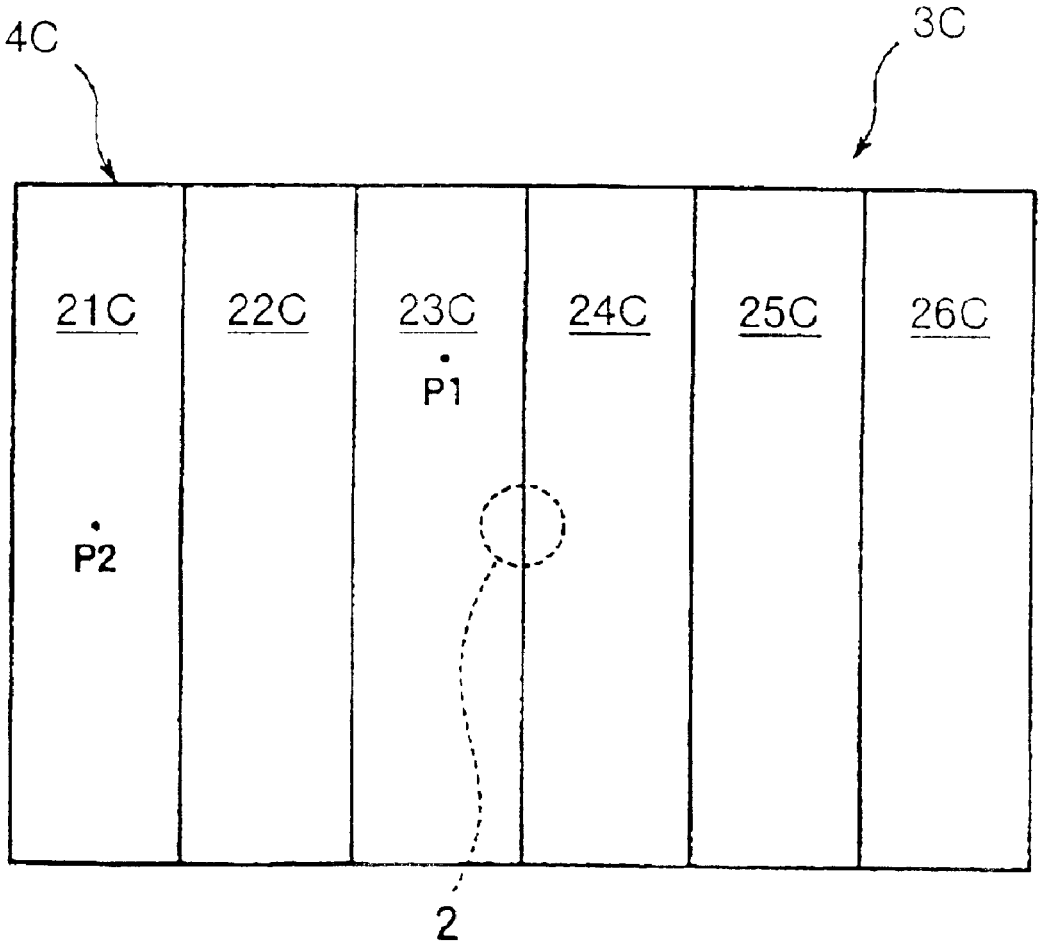
FIG. 39 is a front view of the reflecting surface.
Figure 40B:
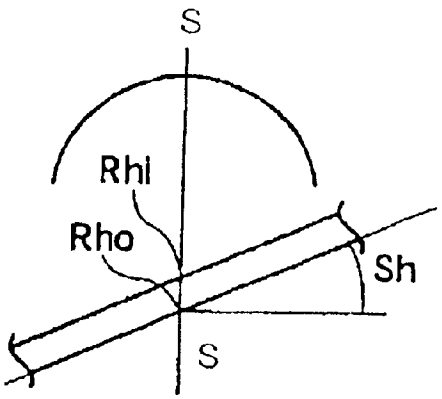
FIG. 40B is a cross-sectional view taken along the line B—B in FIG. 40A.
Figure 40A:
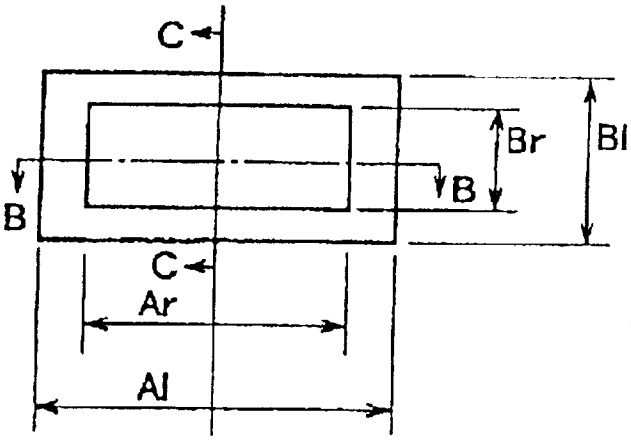
FIG. 40A is a front view for explaining data to be input to optical simulation.
Figure 40C:
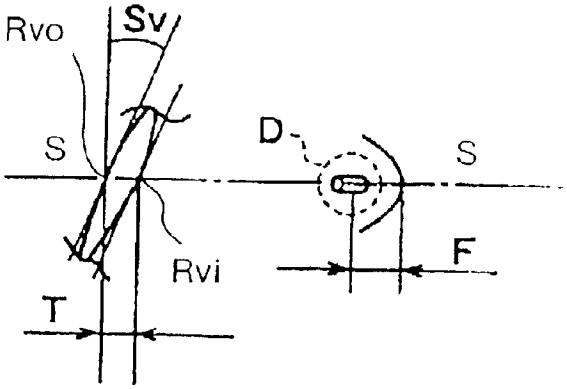
FIG. 40C is a cross-sectional view taken along the line C—C in FIG. 40A.
Figure 40D:
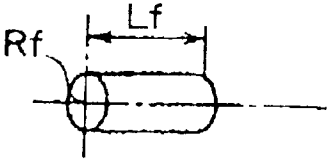
FIG. 40D is an enlarged view of the D portion in FIG. 40C.

The internal surface of the reflector 3C is provided with a reflecting surface 4C such as NURBS as a free curved surface for light distribution. The reflecting surface 4C is formed corresponding to the lens 1C like the reflecting surfaces 4A and 4B of the first and second embodiments. As shown in FIG. 35, this reflecting surface 4C is a substantially hyperboloidal surface (the surface analogous to the hyperboloid) in vertical cross section, which is smaller than the lens 1C, and is a substantially paraboloidal surface in transverse cross section, which is almost the same size as the lens 1C as shown in FIG. 36. As an example of this reflecting surface 4C, the surface is longitudinally divided into six blocks as shown in FIG. 39.

Boundaries of the 6-divided reflecting surface blocks 21C, 22C, 23C, 24C, 25C, and 26C are sometimes visible independently from each other and sometimes not.

The reflecting blocks of the reflecting surface 4C may include those obtained through division of the surface in the lateral direction, other than the longitudinal direction, in the parabolic direction, and in any directions as a combination of the longitudinal direction, lateral direction, and parabolic direction, if necessary. That is, the reflecting surface is divided into blocks in terms of design.

The manufacturing method of the reflecting surface 4C is performed in the same manner as that of the reflecting surfaces 4A and 4B of the first and second embodiments.

The results of performing optical design simulation for the vehicle headlamp according to the third embodiment will be explained in detail below. FIG. 40A to FIG. 40D each show data to be entered to the optical design simulation. The respective data dimensions in FIG. 40A to FIG. 40D are as follows.

Ar=120 mm (lateral dimension of the reflector 3C)

Br=80 mm (longitudinal dimension of the reflector 3C)

Al=120 mm (lateral dimension of the lens 1C)

Bl=120 mm (longitudinal dimension of the lens 1C)

T=20 mm (wall thickness dimension (in the optical axis S) of the lens 1C)

Sv=0° (inclined angle (in the optical axis S) of the side face of the lens 1C)

Sh=0° (inclined angle (in the optical axis S) of the plane of the lens 1C)

Rvo=1400 mm (curvature radius of the side face in the front surface of the lens 1C in the optical axis S)

Rho=1400 mm (curvature radius of the plane in the front surface of the lens 1C in the optical axis S)

Rvi=130 mm (curvature radius of the side face in the rear surface of the lens 1C in the optical axis S)

Rhi=1400 mm (curvature radius of the plane in the rear surface of the lens 1C in the optical axis S)

F=22 mm (focal distance)

Lf=4.6 mm (length of the filament of the light source 2)

Rf=0.73 mm (radius of the filament of the light source 2)

The respective data is entered to the following table 5 as each value. Note that the conditions are assumed to satisfy the European Light Distribution Standard ECEReg.

TABLE 5

| Reflector 3C | | |
|---|---|---|
| Width | Height | Focal distance |
| Ar (mm) | Br (mm) | F (mm) |
| 120 | 80 | 22 |

The light source 2 of the vehicle headlamp according to the third embodiment is lit to obtain the result shown in the following table 6.

TABLE 6

| | | |
|---|---|---|
| European Light Distribution Standard | | Satisfied |
| Maximum luminous intensity (cd) | | 22830 |
| Using luminous intensity (1m) | | 404 |
| Light-emitting part of the lens (mm) | Height | 120 |
| | Width | 120 |
| | Wall thickness | 20 |

Figure 42:
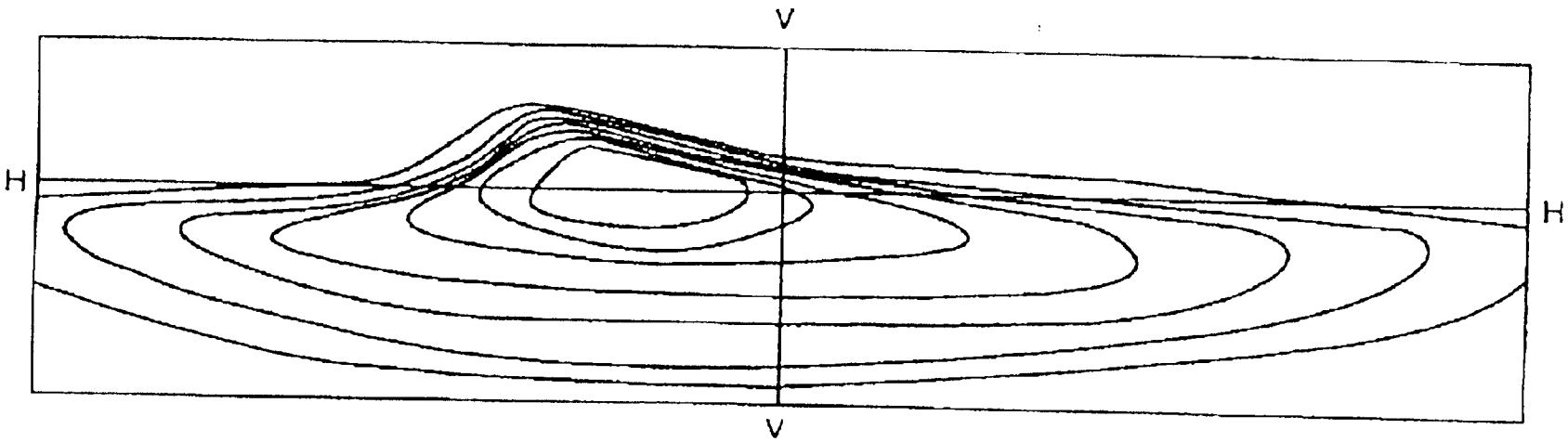
FIG. 42 is an isolux curve showing a target low-beam light distribution pattern by the vehicle headlamp according to the third embodiment.

The light source 2 of the vehicle headlamp according to the third embodiment is lit and thereby a target light distribution pattern as shown in FIG. 42 is obtained.

The target light distribution pattern shown in FIG. 42 is the low-beam light distribution pattern based on left-side driving, and is controlled by the respective reflecting surface blocks 21C to 26C of the reflecting surface 4C of the reflector 3C. That is, of the reflecting surface 4C of the reflector 3C shown in FIG. 39, the reflecting surface block 21C at the first from the left controls to obtain the light distribution pattern shown in FIG. 43. The reflecting surface block 22C at the second from the left controls to obtain the light distribution pattern shown in FIG. 44. The reflecting surface block 23C at the third from the left controls to obtain the light distribution pattern shown in FIG. 45. The reflecting surface block 24C at the fourth from the left controls to obtain the light distribution pattern shown in FIG. 46. The reflecting surface block 25C at the fifth from the left controls to obtain the light distribution pattern shown in FIG. 47. The reflecting surface block 26C at the sixth from the left controls to obtain the light distribution pattern shown in FIG. 48. The light distribution patterns (FIG. 43 to FIG. 48) obtained through control of these reflecting surface blocks 21C to 26C are combined, and thereby the target light distribution pattern shown in FIG. 42 can be obtained.

As clearly seen from FIG. 43 to FIG. 48, since the reflecting blocks 21C, 22C, and 26C at the first, second, and sixth from the top are apart from the light source 2, the reflected light beams are low. Therefore, low reflected light beams are collected to form a hot zone in these reflecting blocks 21C, 22C, and 26C. Accordingly, each of the reflecting surfaces of these reflecting blocks 21C, 22C, and 26C mainly forms a concave face.

On the other hand, since the reflecting blocks 23C to 25C in the third to fifth from the left are close to the light source 2, the reflected light beams are high and therefore highly reflected light beams with which only a simple spot light is formed are dispersed. Accordingly, each of the reflecting surfaces of these reflecting blocks 23C to 25C mainly forms a convex face.

The reflecting surface 4C is logically designed here assuming the light source 2 as a spot light source. The actual light source 2, however, has a length and a width (radius) of the filament and is not therefore the spot light source but a surface light source as clearly seen in FIG. 35 and FIG. 36.

Figure 41A:
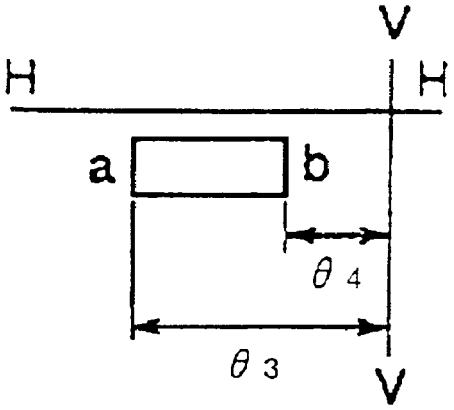
FIG. 41A shows a typical light distribution pattern formed through projection of a pin point $P_2$ in FIG. 39 to the screen.
Figure 41B:
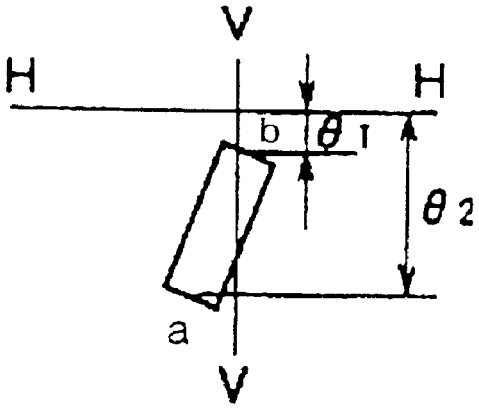
FIG. 41B shows a typical light distribution pattern formed through projection of a pin point $P_1$ in FIG. 39 to the screen.
Figure 45:
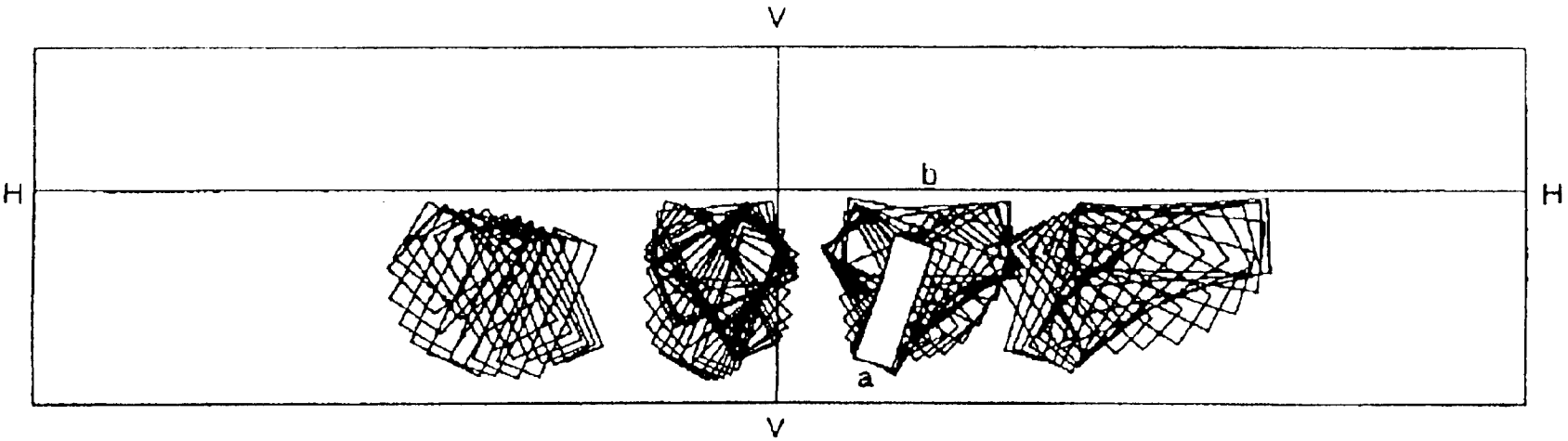
FIG. 45 shows a light distribution pattern obtained by the lens 1C shown in FIG. 35 to FIG. 38 and the reflecting surface block 23C at the third from the left of the reflecting surface 4C shown in FIG. 39, and shown by simplification of the light distribution pattern obtained through computer simulation.
Figure 46:
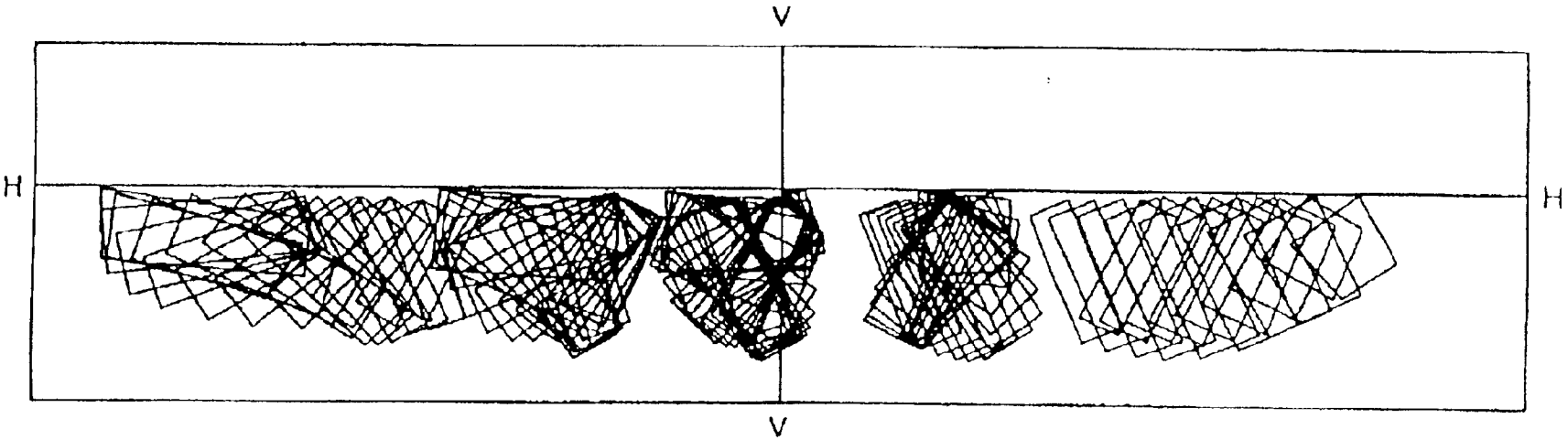
FIG. 46 shows a light distribution pattern obtained by the lens 1C shown in FIG. 35 to FIG. 38 and the reflecting surface block 24C at the fourth from the left of the reflecting surface 4C shown in FIG. 39, and shown by simplification of the light distribution pattern obtained through computer simulation.
Figure 47:
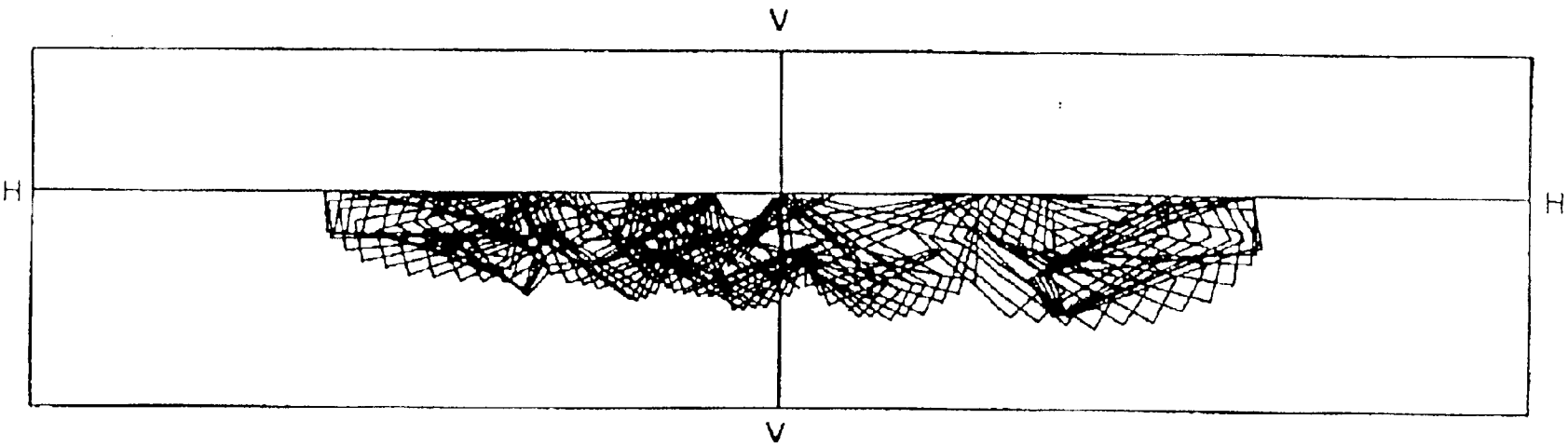
FIG. 47 shows a light distribution pattern obtained by the lens 1C shown in FIG. 35 to FIG. 38 and the reflecting surface block 25C at the fifth from the left of the reflecting surface 4C shown in FIG. 39, and shown by simplification of the light distribution pattern obtained through computer simulation.
Figure 48:
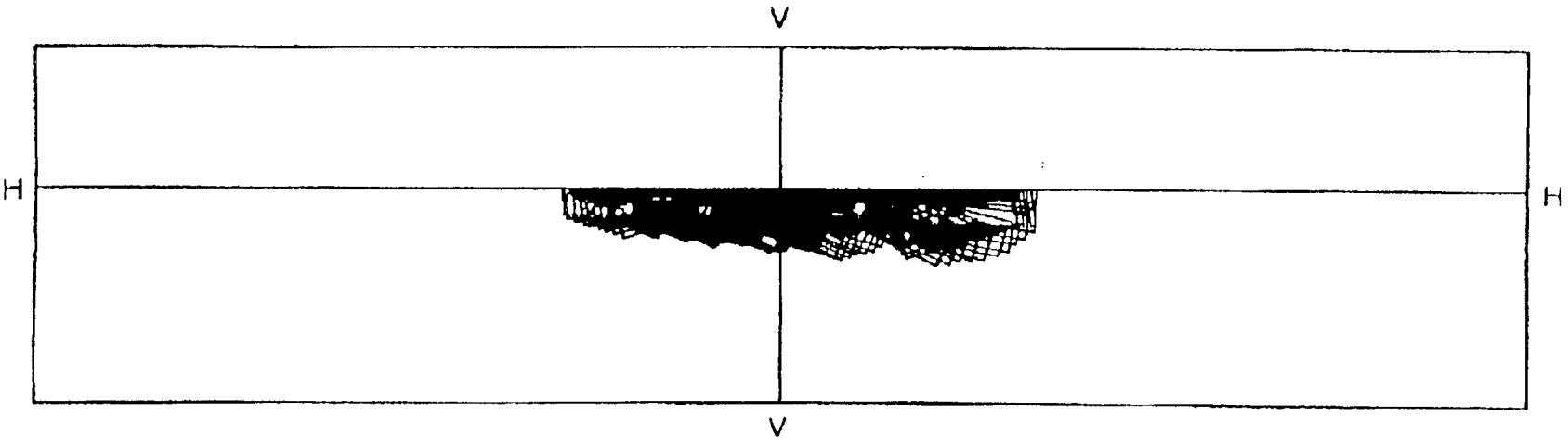
FIG. 48 shows a light distribution pattern obtained by the lens 1C shown in FIG. 35 to FIG. 38 and the reflecting surface block 26C at the sixth from the left of the reflecting surface 4C shown in FIG. 39, and shown by simplification of the light distribution pattern obtained through computer simulation.

Therefore, as shown in FIG. 39, for example, when the light of the light source 2 is reflected at a point $P_1$ of the reflecting surface 23C at the third from the left, the light beam $L_5$ emitted from the rear end b of the light source (filament) 2 is emitted downward by an angle $\theta_1$ with respect to the horizontal line $S_1$, as shown in FIG. 35. On the other hand, the light beam $L_4$ emitted from the front end a of the light source (filament) 2 is emitted downward by an angle $\theta_2$ with respect to the horizontal line $S_1$. The emitted light beams $L_4$ and $L_5$ have longitudinally long lengths at a substantially central part on the screen as shown in FIG. 41B and FIG. 45, and are slightly inclined by a displacement in the lateral direction from the light source 2. The angles $\theta_1$ and $\theta_2$ of the light beams $L_4$ and $L_5$ emitted from the lens 1C with respect to the horizontal line $S_1$, are, as shown in FIG. 41B, the same as angles $\theta_1$ and $\theta_2$ from the horizontal line H—H on the screen.

Figure 43:
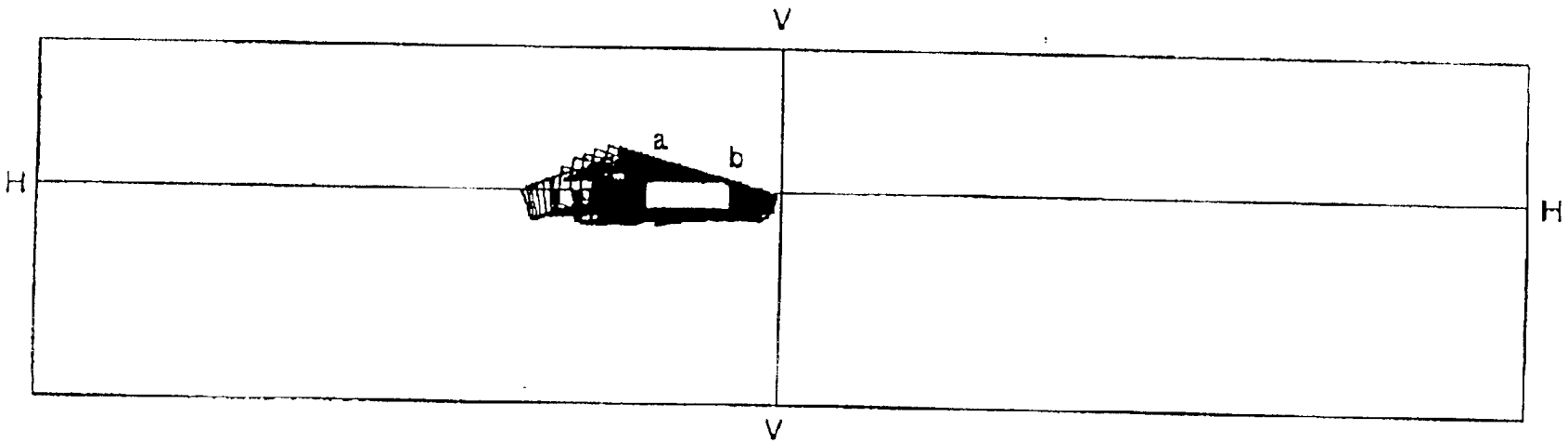
FIG. 43 shows a light distribution pattern obtained by the lens 1C shown in FIG. 35 to FIG. 38 and the reflecting surface block 21C at the first from the left of the reflecting surface 4C shown in FIG. 39, and shown by simplification of the light distribution pattern obtained through computer simulation.
Figure 44:
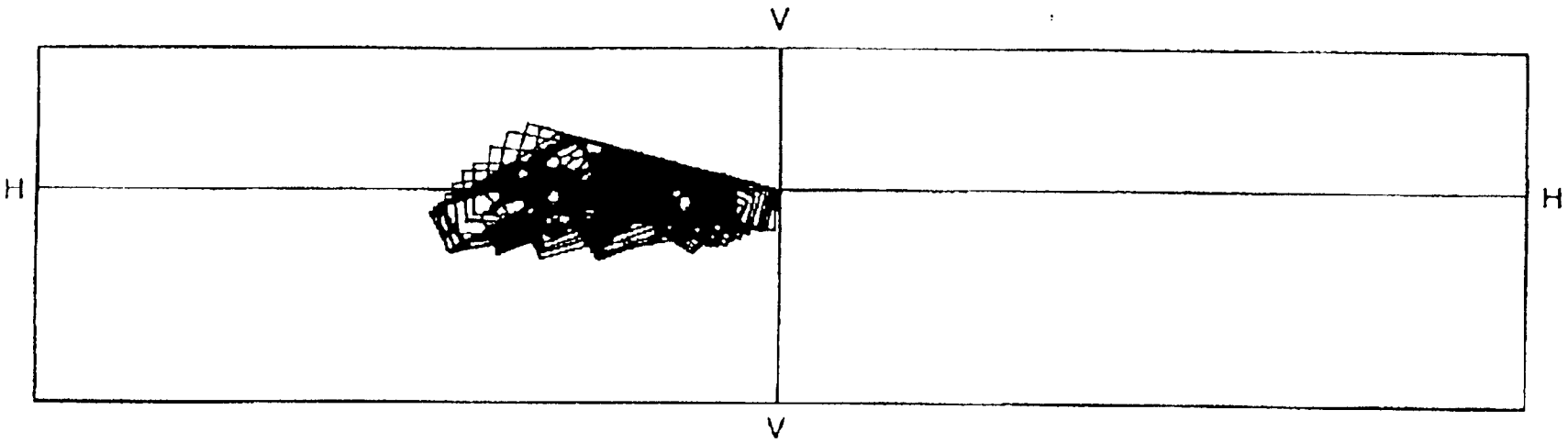
FIG. 44 shows a light distribution pattern obtained by the lens 1C shown in FIG. 35 to FIG. 38 and the reflecting surface block 22C at the second from the left of the reflecting surface 4C shown in FIG. 39, and shown by simplification of the light distribution pattern obtained through computer simulation.

As shown in FIG. 39, for example, when the light of the light source 2 is reflected at a point $P_2$ in the reflecting surface block 21C at the first from the left, the light beam $L_5$ emitted from the rear end b of the light source (filament) 2 is emitted inward by an angle $\theta_4$ with respect to the vertical line $S_2$, as shown in FIG. 36. On the other hand, the light beam $L_4$ emitted from the front end a of the light source (filament) 2 is emitted inward by an angle $\theta_3$ with respect to the vertical line $S_2$. The emitted light beams $L_4$ and $L_5$ have laterally long lengths at the central part yet slightly left on the screen as shown in FIG. 41A and FIG. 43. The angles $\theta_3$ and $\theta_4$ of the light beams $L_4$ and $L_5$ emitted from the lens 1C with respect to the vertical line $S_2$ are, as shown in FIG. 41A, the same as angles $\theta_3$ and $\theta_4$ from the vertical line V—V on the screen.

As explained above, the free curved surface formed on the reflecting surface 4C is provided so that the light distribution patterns generated by the free curved surface are computer-simulated to analyze light distribution properties so as to form an optimal light distribution pattern. Therefore, when the light beams $L_2$ and $L_3$ reflected by the reflecting surface 4C pass through the lens 1C and are to be emitted to the outside, the light beams $L_4$ and $L_5$ emitted from the lens 1C form the most appropriate light distribution pattern.

Moreover, in the third embodiment, the free curved surface (NURBS) is formed also on the front surface and rear surface of the lens 1C, and thereby the light distribution function can be imparted not only to the reflecting surface 4C but also to the lens 1C, so that a more ideal light distribution pattern can be obtained.

Particularly, the vehicle headlamp according to the third embodiment has the lens 1C with a convex shape in vertical cross section, and thereby even if the prism is not formed thereon, light is largely refracted by the lens 1C and the interior is harder to be seen from the outside. Consequently, the vehicle headlamp according to the third embodiment does not require giving a finish more than optical performance required for reflection to the front surface of the reflecting surface 4C of the reflector 3C, which is for the purpose of enhancement of its appearance, thus the machining work is easier than the conventional work.

Further, the vehicle headlamp according to the third embodiment has the lens 1C with a flat shape in transverse cross section, and therefore the lens 1C can be easily polished when it is made of glass, which is excellent in manufacture of the lens 1C.

Figure 37:
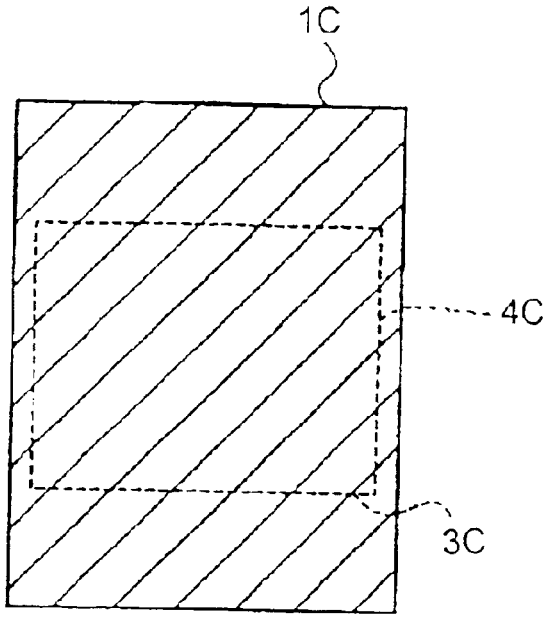
FIG. 37 is its front view.
Figure 38:
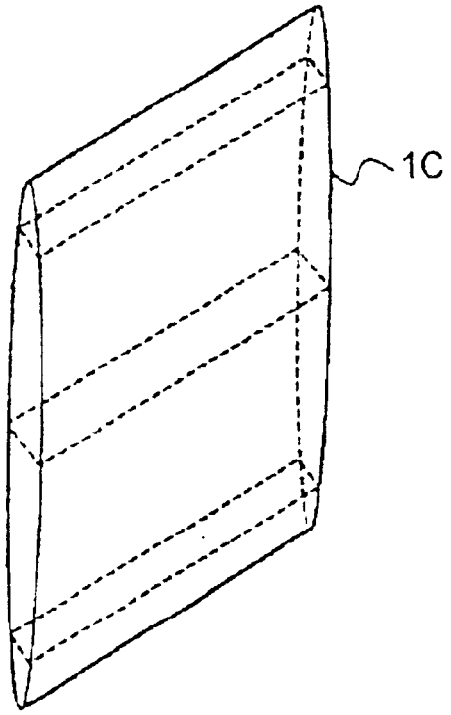
FIG. 38 is a perspective view of the lens.

The lens 1C of the third embodiment has a convex shape in vertical cross section and a flat shape in transverse cross section. Therefore, in vertical cross section of the lens 1C, as shown in FIG. 35, the light beams $L_2$ and $L_3$ dispersed by the substantially hyperboloidal surface of the reflecting surface 4C are converged in the direction substantially along the optical axis S. While in the transverse cross section of the lens 1C, as shown in FIG. 36, the light beams $L_2$ and $L_3$ reflected by the substantially paraboloidal surface of the reflecting surface 4C pass through the lens 1C as they are in the direction substantially along the optical axis S, and are emitted to the outside as the target light distribution pattern. As a result, the third embodiment provides the vehicle headlamp using the lens 1C with a longitudinally elongated shape when viewed from the front side as shown in FIG. 37. Therefore, the third embodiment is right fit for car body design in a case where the front section cannot afford to keep sufficient room for installation of the vehicle headlamp in lateral dimensions.

Further, the reflecting surface 4C in the third embodiment is a substantially hyperboloidal surface in vertical cross section, which is smaller than the lens 1C, and is a substantially paraboloidal surface in transverse cross section, which is almost the same size as that of the lens 1C. Therefore, in the vertical cross section of the reflecting surface 4C, as shown in FIG. 35, the light beams $L_2$ and $L_3$ can be led to the lens 1C while being kept vertically dispersed with respect to the optical axis S. Further, in the transverse cross section of the reflecting surface 4C, as shown in FIG. 36, the light beams $L_2$ and $L_3$ can be led to the lens 1C while being kept substantially along the optical axis S. As a result, the third embodiment is the most suitable for a combination with the lens 1C having a convex shape in vertical cross section and a flat shape in transverse cross section. As shown in FIG. 37, the vehicle headlamp whose front surface (the surface of the lens 1C) is longitudinally long and laterally short can easily be obtained. Furthermore, in the vertical direction of the reflecting surface 4C, the longitudinal dimension of the reflector 3C can be minimized by the substantially hyperboloidal surface that is smaller than the lens 1C.

Figure 49A:
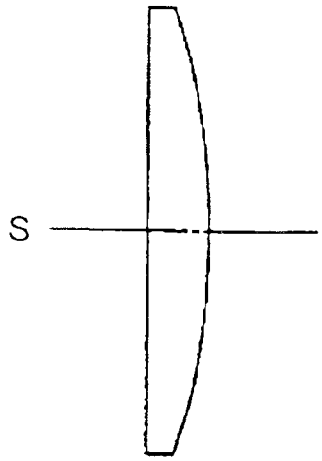
FIG. 49A, FIG. 49B, and FIG. 49C are cross-sectional views showing modified examples of the convex shape of the lens in cross section.
Figure 49B:
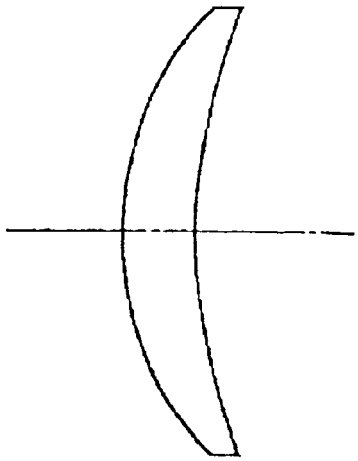
Figure 49C:
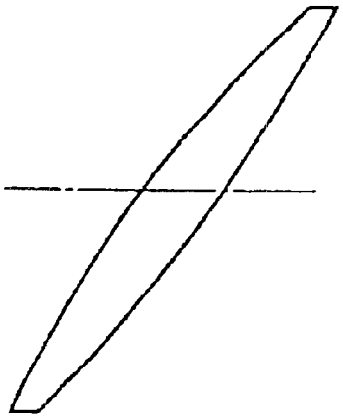

In the third embodiment, the convex shape of the lens 1C in vertical cross section here indicates a shape having an optical function that refracts an incident light in a direction in which the light is converged from the optical axis S in the vertical cross section of the lens 1C. Therefore, the convex shape includes a shape having a convex shape only in one side as shown in FIG. 49A, a shape having a concave shape in one side and a convex shape in the other side whose degree of curve is greater than that of the concave shape as shown in FIG. 49B, and a shape inclined with respect to the optical axis S as shown in FIG. 49C.

FIG. 50 to FIG. 64 show a fourth embodiment. In the figures, the same legends as these in FIG. 1 to FIG. 49 represent the same sections.

The vehicle headlamp according to the fourth embodiment comprises the lens 1D, light source 2, and the reflector 3D.

The lens 1D, as shown in FIG. 50 to FIG. 53, has an outside shape of a laterally elongated rectangle when viewed from the front side, a flat shape in vertical cross section, and a convex shape in transverse cross section. The lens 1D is formed like the lenses 1A, 1B, and 1C of the first, second, and third embodiments. That is, the lens 1D is not provided with a prism for light distribution. NURBS as a free curved surface for light distribution is formed on the front surface and the rear surface of the lens 1D.

Figure 50:
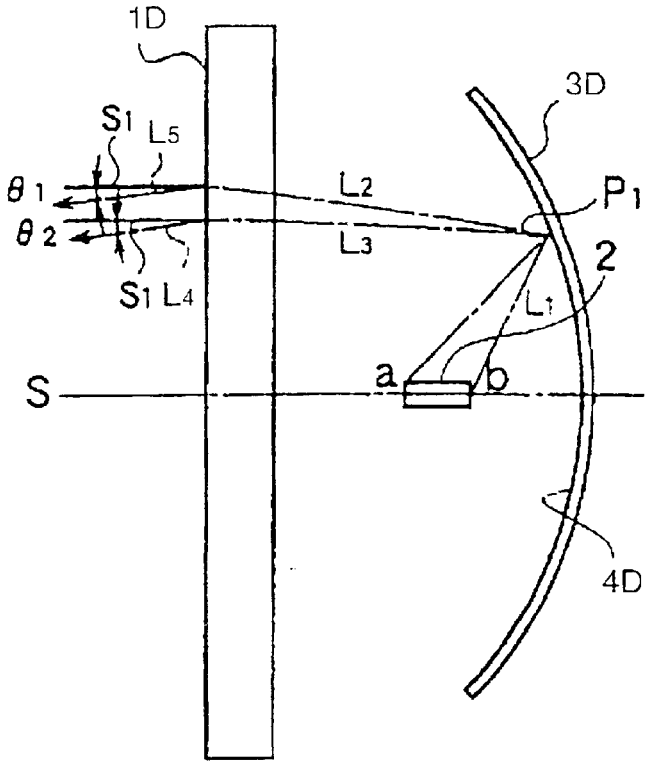
FIG. 50 is a vertical sectional view schematically showing a vehicle headlamp according to a fourth embodiment of this invention.
Figure 51:
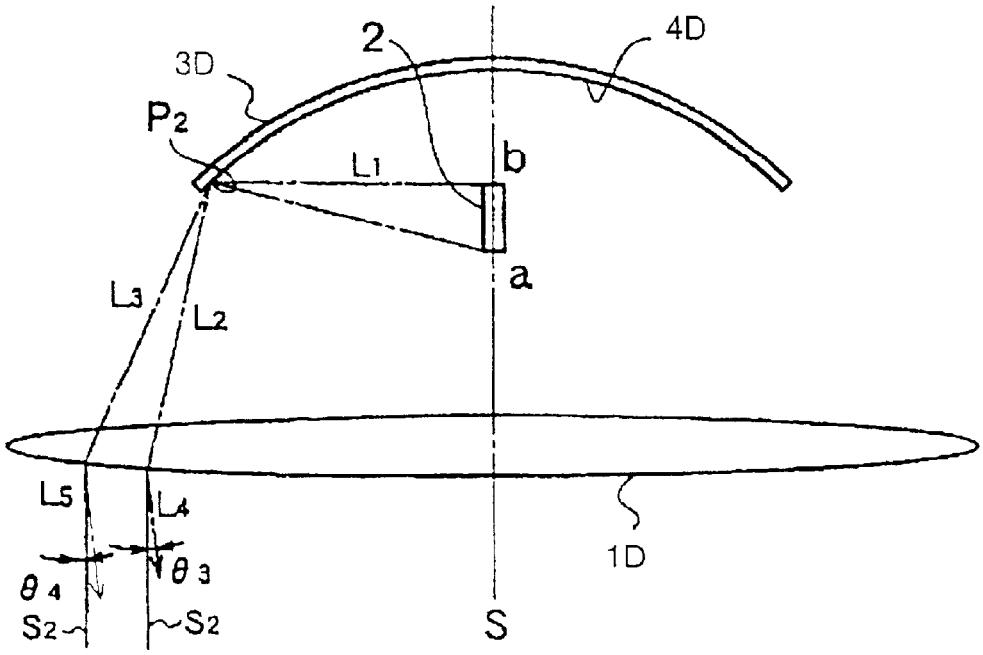
FIG. 51 is its transverse sectional view.
Figure 54:
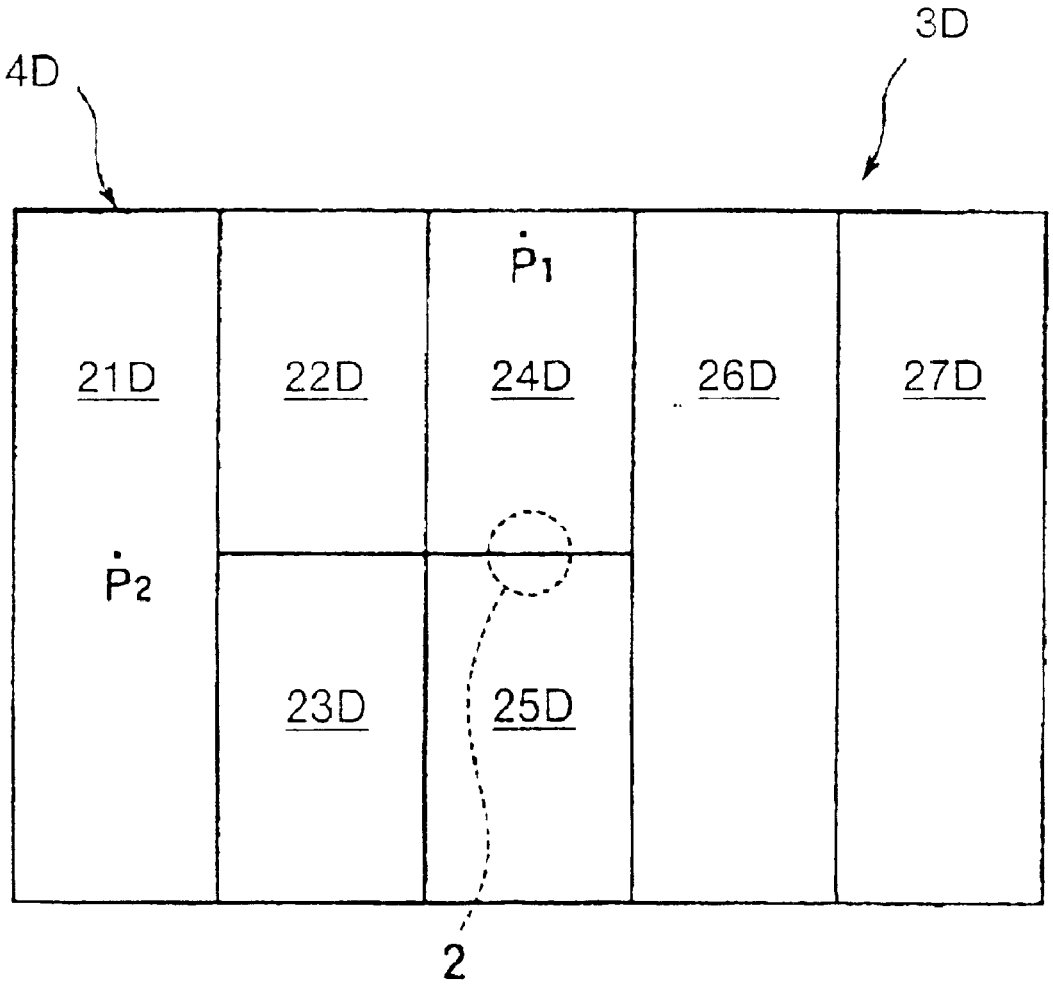
FIG. 54 is a front view of the reflecting surface.
Figure 55B:
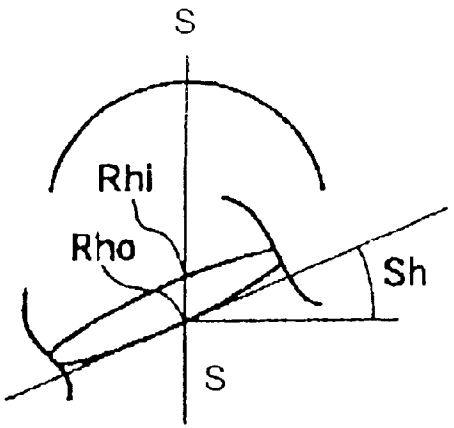
FIG. 55B is a cross-sectional view taken along the line B—B in FIG. 55A.
Figure 55A:
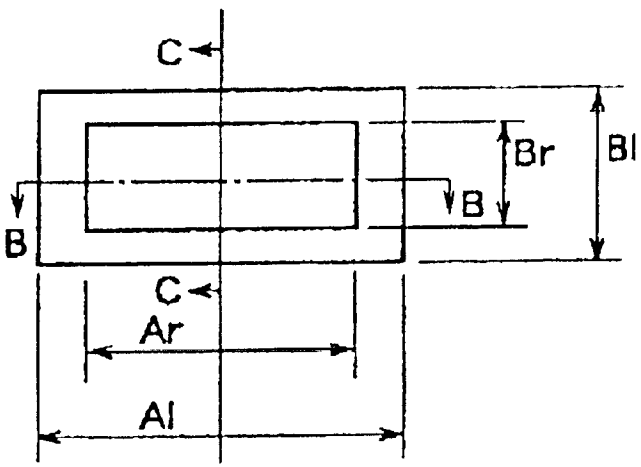
FIG. 55A is a front view for explaining data to be input to optical simulation.
Figure 55C:
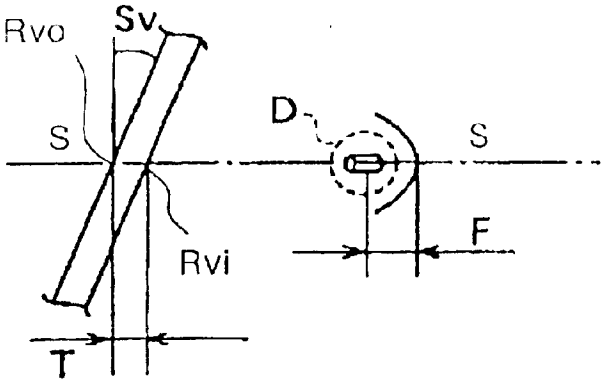
FIG. 55C is a cross-sectional view taken along the line C—C in FIG. 55A.
Figure 55D:
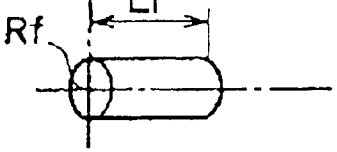
FIG. 55D is an enlarged view of the D portion in FIG. 55C.

The internal surface of the reflector 3D is provided with a reflecting surface 4D such as NURBS as a free curved surface for light distribution. The reflecting surface 4D is formed corresponding to the lens 1D like the reflecting surfaces 4A, 4B, and 4C of the first, second, and third embodiments. As shown in FIG. 50, this reflecting surface 4D is a substantially paraboloidal surface in vertical cross section, which is almost the same size as the lens 1D, and is a substantially hyperboloidal surface in transverse cross section, which is smaller than the lens 1D as shown in FIG. 51. As an example of this reflecting surface 4D, the surface is longitudinally divided into five blocks, two of which are also laterally divided into two, respectively, so that the surface eventually has seven blocks in total, as shown in FIG. 54.

Boundaries of the 7-divided reflecting surface blocks 21D, 22D, 23D, 24D, 25D, 26C, and 27D are sometimes visible independently from each other and sometimes not.

The reflecting blocks of the reflecting surface 4D may include those obtained through division of the surface in the longitudinal direction, in the lateral direction, in the parabolic direction, and in any directions as a combination of the longitudinal direction, lateral direction, and parabolic direction, if necessary. That is, the reflecting surface is divided into blocks in terms of design.

The manufacturing method of the reflecting surface 4D is performed in the same manner as that of the reflecting surfaces 4A, 4B, and 4C of the first, second, and third embodiments.

The results of performing optical design simulation for the vehicle headlamp according to the fourth embodiment will be explained in detail below. FIG. 55A to FIG. 55D each show data to be entered to the optical design simulation. The respective data dimensions in FIG. 55A to FIG. 55D are as follows.

Ar=100 mm (lateral dimension of the reflector 3D)

Br=100 mm (longitudinal dimension of the reflector 3D)

Al=120 mm (lateral dimension of the lens 1D)

Bl=100 mm (longitudinal dimension of the lens 1D)

T=28 mm (wall thickness dimension (in the optical axis S) of the lens 1D)

Sv=0° (inclined angle (in the optical axis S) of the side face of the lens 1D)

Sh=0° (inclined angle (in the optical axis S) of the plane of the lens 1D)

Rvo=1400 mm (curvature radius of the side face in the front surface of the lens 1D in the optical axis S)

Rho=−300 mm (curvature radius of the plane in the front surface of the lens 1D in the optical axis S)

Rvi=1400 mm (curvature radius of the side face in the rear surface of the lens 1D in the optical axis S)

Rhi=200 mm (curvature radius of the plane in the rear surface of the lens 1D in the optical axis S)

F=18 mm (focal distance)

Lf=4.6 mm (length of the filament of the light source 2)

Rf=0.73 mm (radius of the filament of the light source 2)

The respective data is entered to the following table 7 as each value. Note that the conditions are assumed to satisfy the European Light Distribution Standard ECEReg.

TABLE 7

| Reflector 3D | | |
|---|---|---|
| Width | Height | Focal distance |
| Ar (mm) | Br (mm) | F (mm) |
| 100 | 100 | 18 |

The light source 2 of the vehicle headlamp according to the fourth embodiment is lit to obtain the result shown in the following table 8.

TABLE 8

| | | |
|---|---|---|
| European Light Distribution Standard | | Satisfied |
| Maximum luminous intensity (cd) | | 18000 |
| Using luminous intensity (1m) | | 412 |
| Light-emitting part of the lens (mm) | Height | 100 |
| | Width | 120 |
| | Wall thickness | 28 |

Figure 57:
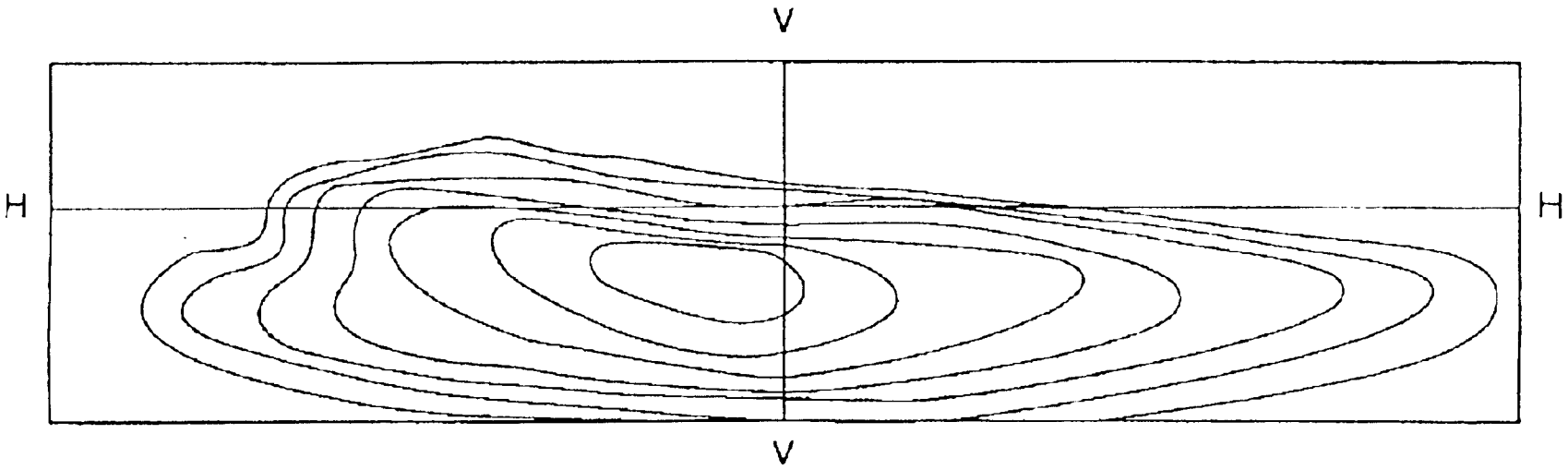
FIG. 57 is an isolux curve showing a target low-beam light distribution pattern by the vehicle headlamp according to the fourth embodiment.

The light source 2 of the vehicle headlamp according to the fourth embodiment is lit and thereby a target light distribution pattern as shown in FIG. 57 is obtained.

The target light distribution pattern shown in FIG. 57 is the low-beam light distribution pattern based on left-side driving, and is controlled by the respective reflecting surface blocks 21D to 27D of the reflecting surface 4D of the reflector 3D. That is, of the reflecting surface 4D of the reflector 3D shown in FIG. 54, the reflecting surface block 21D at the first from the left controls to obtain the light distribution pattern shown in FIG. 58. The upper reflecting surface block 22D at the second from the left controls to obtain the light distribution pattern shown in FIG. 59. The lower reflecting surface block 23D at the second from the left controls to obtain the light distribution pattern shown in FIG. 60. The upper reflecting surface block 24D at the third from the left controls to obtain the light distribution pattern shown in FIG. 61. The lower reflecting surface block 25D at the third from the left controls to obtain the light distribution pattern shown in FIG. 62. The reflecting surface block 26D at the fourth from the left controls to obtain the light distribution pattern shown in FIG. 63. The reflecting surface block 27D at the fifth from the left controls to obtain the light distribution pattern shown in FIG. 64. The light distribution patterns (FIG. 58 to FIG. 64) obtained through control of these reflecting surface blocks 21D to 27D are combined, and thereby the target light distribution pattern shown in FIG. 57 can be obtained. Note that the "upper" and "lower" used in the explanation of the reflecting blocks 21D to 27D indicate the positions with respect to the light source 2.

As clearly seen from FIG. 58 to FIG. 64, in the reflecting blocks 21D and 27D at the first and fifth from the left, the light source 2 (filament) is projected in a substantially lateral position. In the reflecting blocks 22D, 23D, and 26D at the upper and lower sides of the second from the left and at the fourth from the left, the light source 2 (filament) is projected in an inclined position. In the reflecting blocks 24D and 25D at the upper and lower sides of the third from the left, the light source 2 (filament) is projected in a substantially longitudinal position.

The reflecting surface 4D is logically designed here assuming the light source 2 as a spot light source. The actual light source 2, however, has a length and a width (radius) of the filament and is not therefore the spot light source but a surface light source as clearly seen in FIG. 50 and FIG. 51.

Figure 56A:
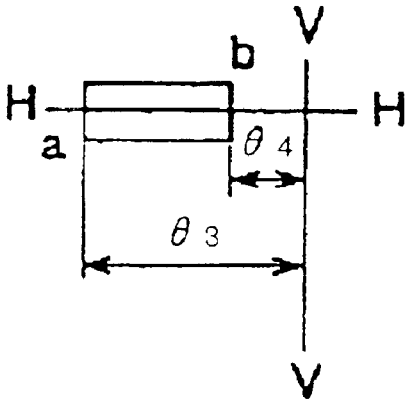
FIG. 56A shows a typical light distribution pattern formed through projection of a pin point $P_2$ in FIG. 54 to the screen.
Figure 56B:
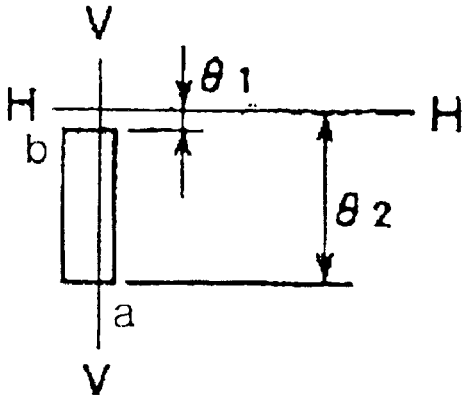
FIG. 56B shows a typical light distribution pattern formed through projection of a pin point $P_1$ in FIG. 54 to the screen.
Figure 61:
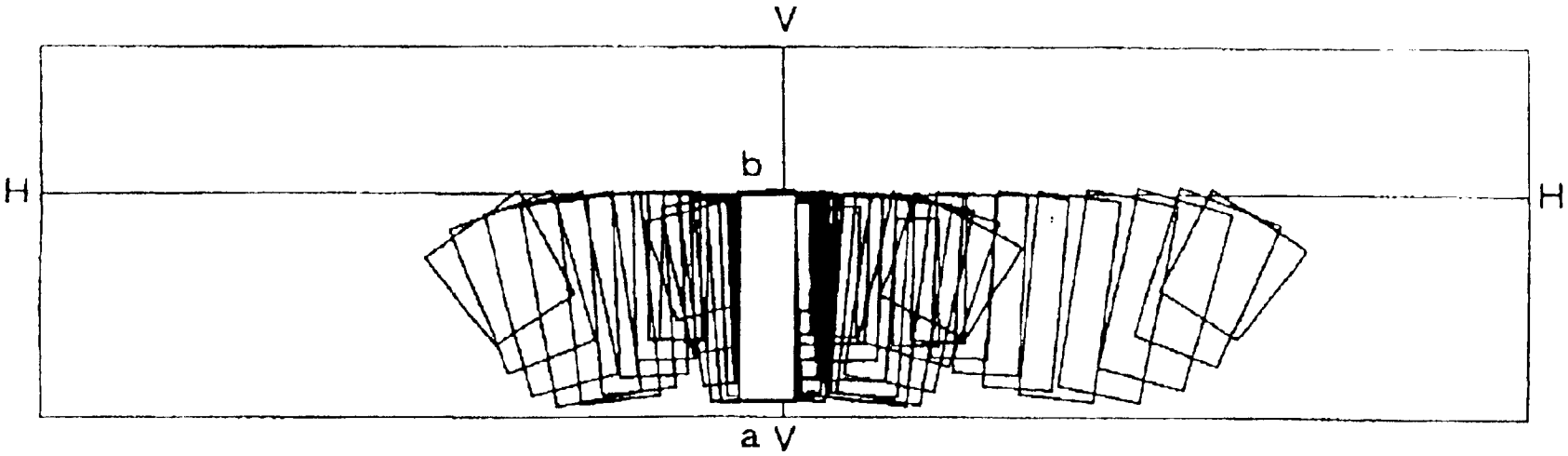
FIG. 61 shows a light distribution pattern obtained by the lens ID shown in FIG. 50 to FIG. 53 and the upper reflecting surface block 24D at the third from the left of the reflecting surface 4D shown in FIG. 54, and shown by simplification of the light distribution pattern obtained through computer simulation.
Figure 62:
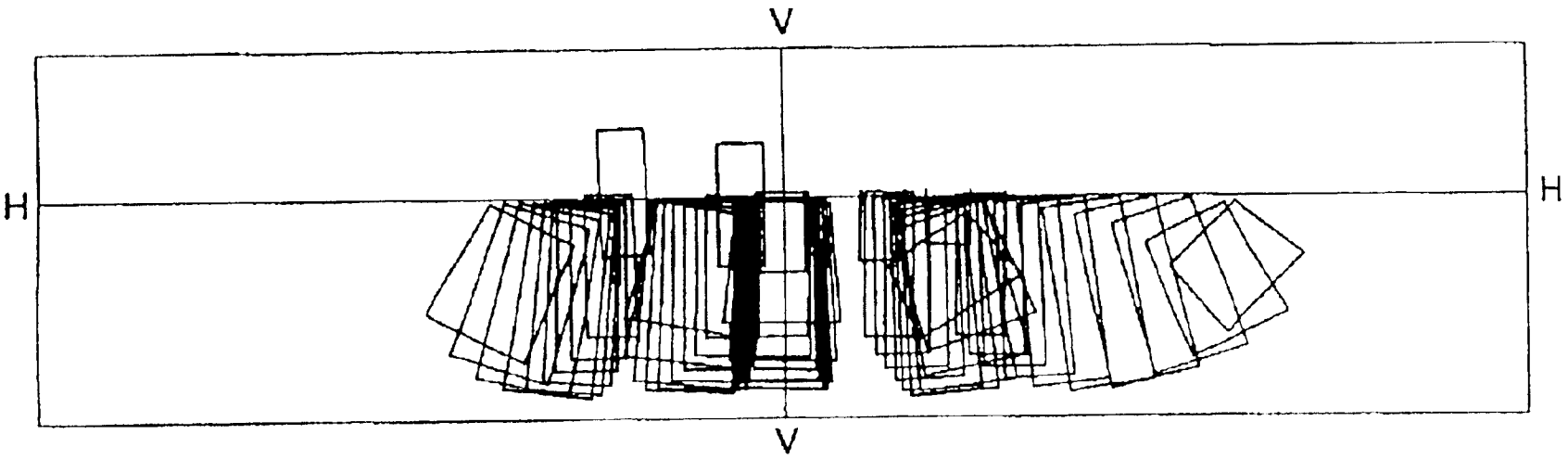
FIG. 62 shows a light distribution pattern obtained by the lens 1D shown in FIG. 50 to FIG. 53 and the lower reflecting surface block 25D at the third from the left of the reflecting surface 4D shown in FIG. 54, and shown by simplification of the light distribution pattern obtained through computer simulation.
Figure 63:
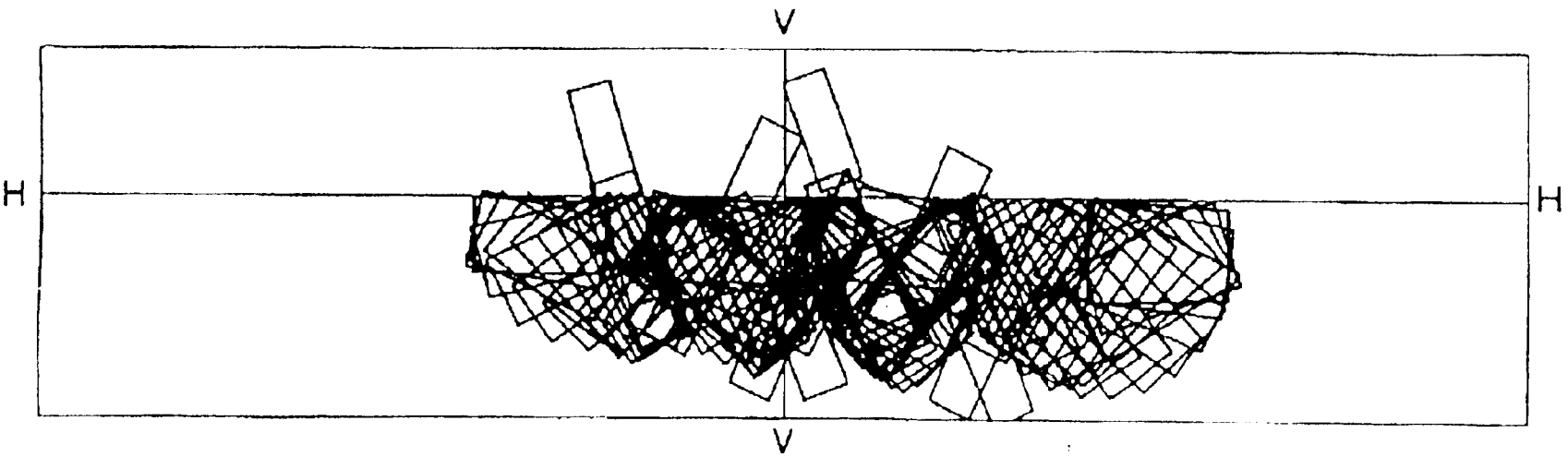
FIG. 63 shows a light distribution pattern obtained by the lens 1D shown in FIG. 50 to FIG. 53 and the reflecting surface block 26D at the fourth from the left of the reflecting surface 4D shown in FIG. 54, and shown by simplification of the light distribution pattern obtained through computer simulation.
Figure 64:
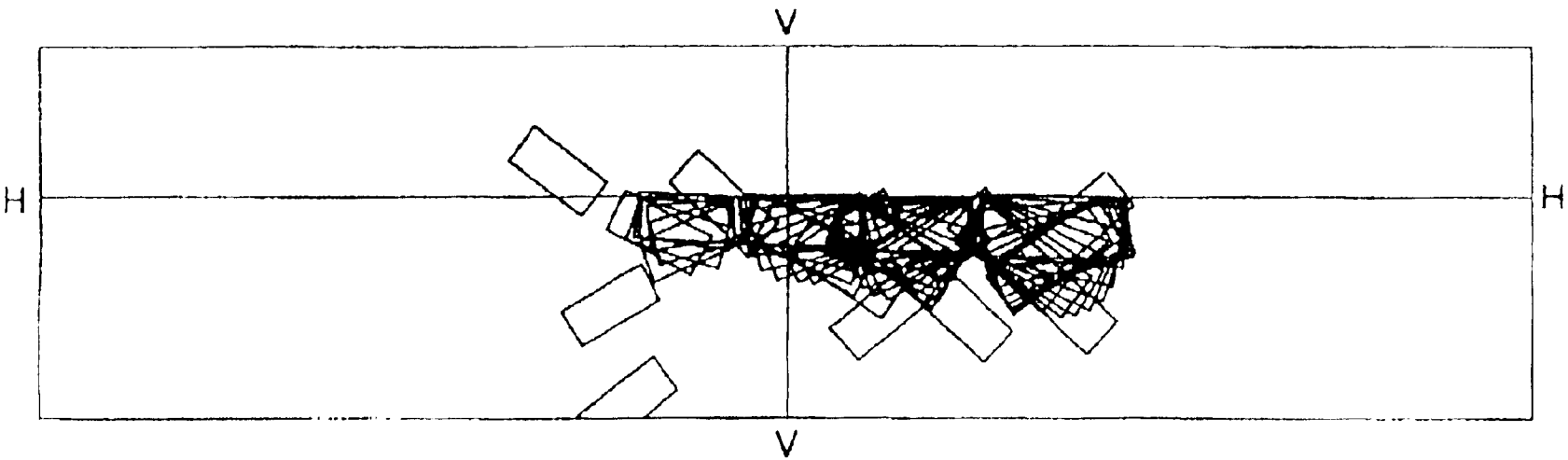
FIG. 64 shows a light distribution pattern obtained by the lens 1D shown in FIG. 50 to FIG. 53 and the reflecting surface block 27D at the fifth from the left of the reflecting surface 4D shown in FIG. 54, and shown by simplification of the light distribution pattern obtained through computer simulation.

Therefore, as shown in FIG. 54, for example, when the light of the light source 2 is reflected at a point $P_1$ of the upper reflecting surface 24D at the third from the left, the light beam $L_5$ emitted from the rear end b of the light source (filament) 2 is emitted downward by an angle $\theta_1$ with respect to the horizontal line $S_1$, as shown in FIG. 50. On the other hand, the light beam $L_4$ emitted from the front end a of the light source (filament) 2 is emitted downward by an angle $\theta_2$ with respect to the horizontal line $S_1$. The emitted light beams $L_4$ and $L_5$ have vertically long lengths at a substantially central part on the screen as shown in FIG. 56B and FIG. 61. The angles $\theta_1$ and $\theta_2$ of the light beams $L_4$ and $L_5$ emitted from the lens 1D with respect to the horizontal line $S_1$ are, as shown in FIG. 56B, the same as angles $\theta_1$ and $\theta_2$ from the horizontal line H—H on the screen.

Figure 58:
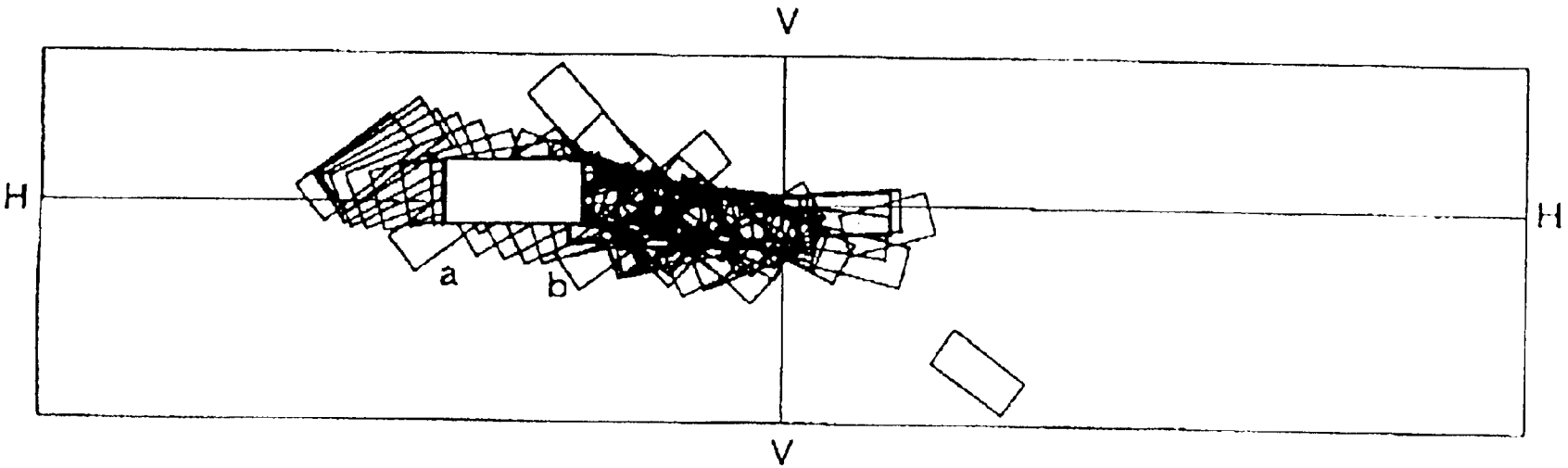
FIG. 58 shows a light distribution pattern obtained by the lens ID shown in FIG. 50 to FIG. 53 and the reflecting surface block 21D at the first from the left of the reflecting surface 4D shown in FIG. 54, and shown by simplification of the light distribution pattern obtained through computer simulation.
Figure 59:
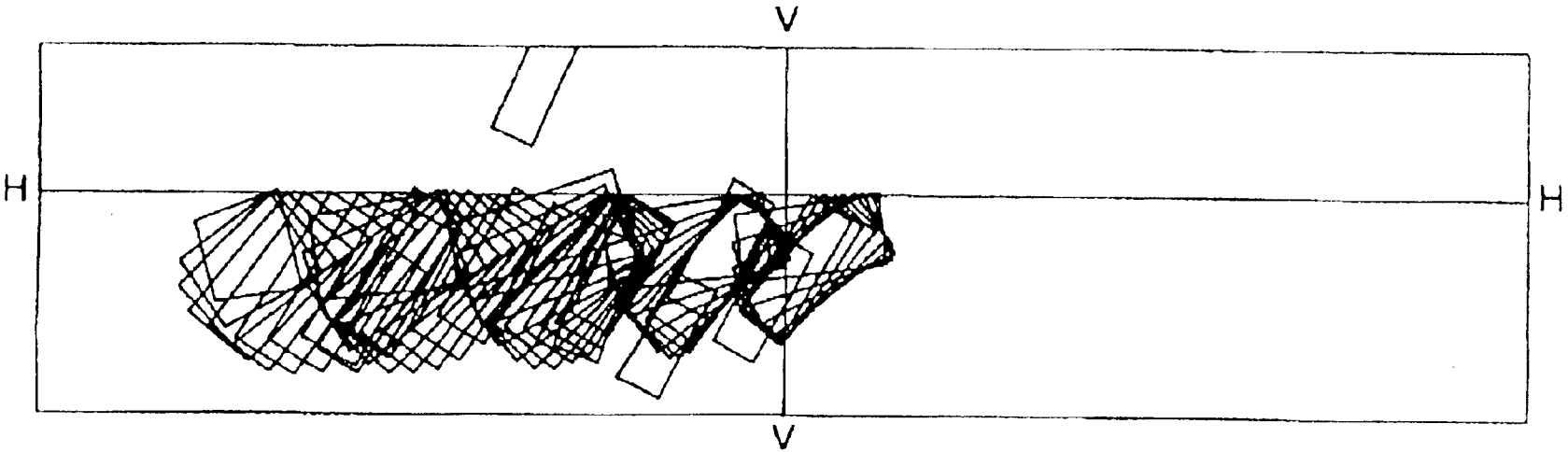
FIG. 59 shows a light distribution pattern obtained by the lens 1D shown in FIG. 50 to FIG. 53 and the upper reflecting surface block 22D at the second from the left of the reflecting surface 4D shown in FIG. 54, and shown by simplification of the light distribution pattern obtained through computer simulation.
Figure 60:
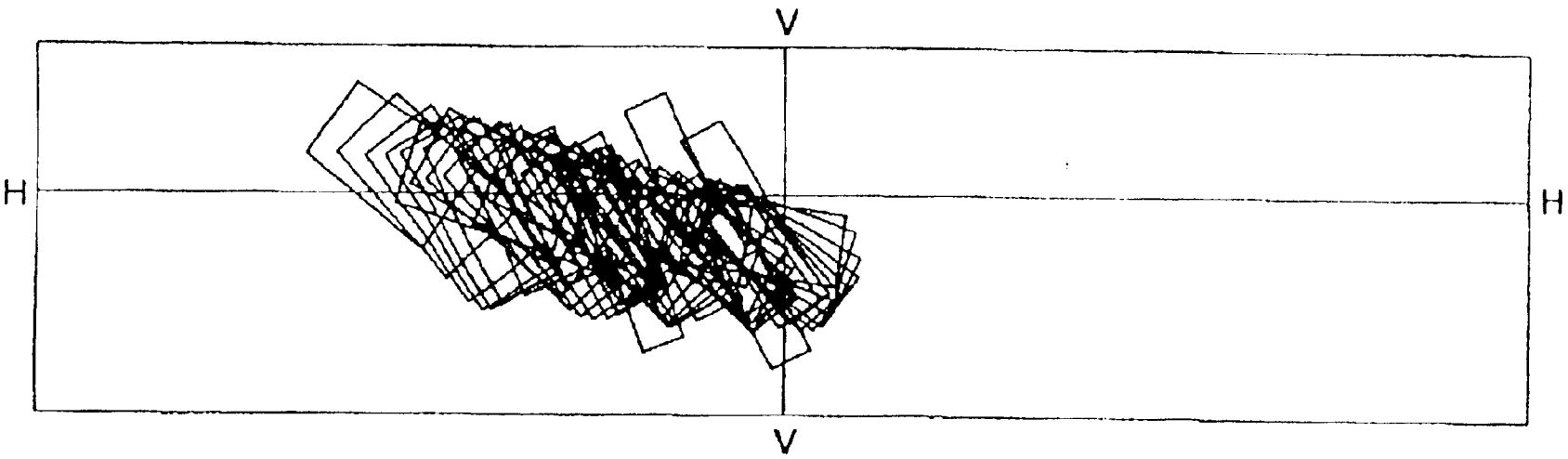
FIG. 60 shows a light distribution pattern obtained by the lens 1D shown in FIG. 50 to FIG. 53 and the lower reflecting surface block 23D at the second from the left of the reflecting surface 4D shown in FIG. 54, and shown by simplification of the light distribution pattern obtained through computer simulation.

As shown in FIG. 54, for example, when the light of the light source 2 is reflected at a point $P_2$ in the reflecting surface block 21D at the first from the left, the light beam $L_5$ emitted from the rear end b of the light source (filament) 2 is emitted inward by an angle $\theta_4$ with respect to the vertical line $S_2$, as shown in FIG. 51. On the other hand, the light beam $L_4$ emitted from the front end a of the light source (filament) 2 is emitted inward by an angle $\theta_3$ with respect to the vertical line $S_2$. The emitted light beams $L_4$ and $L_5$ have laterally long lengths on the horizontal line H—H at the left hand side of the screen as shown in FIG. 56A and FIG. 58. The angles $\theta_3$ and $\theta_4$ of the light beams $L_4$ and $L_5$ emitted from the lens 1D with respect to the vertical line $S_2$ are, as shown in FIG. 56A, the same as angles $\theta_3$ and $\theta_4$ from the vertical line V—V on the screen.

As explained above, the free curved surface formed on the reflecting surface 4D is provided so that the light distribution patterns generated by the free curved surface are computer-simulated to analyze light distribution properties so as to form an optimal light distribution pattern. Therefore, when the light beams $L_2$ and $L_3$ reflected by the reflecting surface 4D pass through the lens 1D and are to be emitted to the outside, the light beams $L_4$ and $L_5$ emitted from the lens 1D form the most appropriate light distribution pattern. Moreover, in the fourth embodiment, the free curved surface (NURBS) is formed also on the front surface and rear surface of the lens 1D, and thereby the light distribution function can be imparted not only to the reflecting surface 4D but also to the lens 1D, so that a more ideal light distribution pattern can be obtained.

Particularly, the vehicle headlamp according to the fourth embodiment has the lens 1D with a convex shape in transverse cross section, and thereby even if the prism is not formed thereon, light is largely refracted by the lens 1D and the interior is harder to be seen from the outside.

Consequently, the vehicle headlamp according to the fourth embodiment does not require giving a finish more than optical performance required for reflection to the front surface of the reflecting surface 4D of the reflector 3D, which is for the purpose of enhancement of its appearance, thus the machining work is easier than the conventional work.

Further, the vehicle headlamp according to the fourth embodiment has the lens 1D with a flat shape in vertical cross section, and therefore the lens 1D can be easily polished when it is made of glass, which is excellent in manufacture of the lens 1D.

Figure 52:
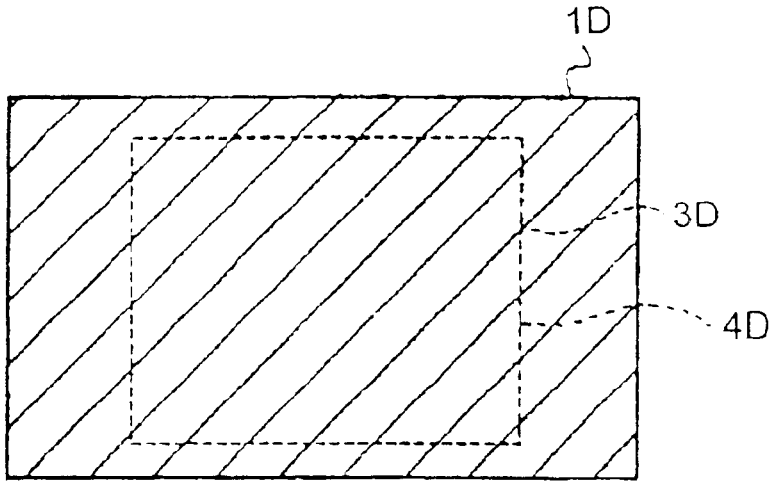
FIG. 52 is its front view.
Figure 53:
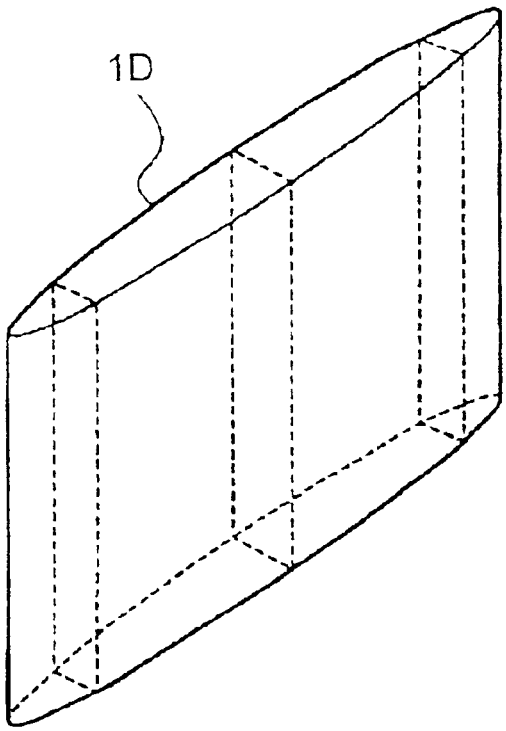
FIG. 53 is a perspective view of the lens.

The lens 1D of the fourth embodiment has a flat shape in vertical cross section and a convex shape in transverse cross section. Therefore, in the vertical cross section of the lens 1D, as shown in FIG. 50, the light beams $L_2$ and $L_3$ reflected by the substantially paraboloidal surface of the reflecting surface 4D pass through the lens 1D as they are in the direction substantially along the optical axis S. While in the transverse cross section of the lens 1D, as shown in FIG. 51, the light beams $L_2$ and $L_3$ dispersed by the substantially hyperboloidal surface of the reflecting surface 4D are converged in the direction substantially along the optical axis S, and are emitted to the outside as the target light distribution pattern. As a result, the fourth embodiment provides the vehicle headlamp using the lens 1D with a longitudinally elongated shape when viewed from the front side as shown in FIG. 52. Therefore, the fourth embodiment is right fit for car body design in a case where the front section cannot afford to keep sufficient room for installation of the vehicle headlamp in longitudinal dimensions.

Further, the reflecting surface 4D of the fourth embodiment is a substantially paraboloidal surface in vertical cross section, which is almost the same size as that of the lens 1D, and is a substantially hyperboloidal surface in transverse cross section, which is smaller than the lens 1D. Therefore, in the vertical cross section of the reflecting surface 4D, as shown in FIG. 50, the light beams $L_2$ and $L_3$ can be led to the lens 1D while being kept substantially along the optical axis S. Further, in the transverse cross section of the reflecting surface 4D, as shown in FIG. 51, the light beams $L_2$ and $L_3$ can be led to the lens 1D while being kept laterally dispersed with respect to the optical axis S. As a result, the fourth embodiment is the most suitable for a combination with the lens 1D having a flat shape in vertical cross section and a convex shape in transverse cross section. As shown in FIG. 52, the vehicle headlamp whose front surface (the surface of the lens 1D) is laterally long and longitudinal short can easily be obtained. Furthermore, in the lateral direction of the reflecting surface 4D, the lateral dimension of the reflector 3D can be minimized by the substantially hyperboloidal surface that is smaller than the lens 1D.

In the fourth embodiment, the convex shape of the lens 1C in vertical cross section here indicates a shape having an optical function that refracts an incident light in a direction in which the light is converged from the optical axis S in the vertical cross section of the lens ID. Therefore, the convex shape includes a shape having a convex shape only in one side as shown in FIG. 49A, a shape having a concave shape in one side and a convex shape in the other side whose degree of curve is greater than that of the concave shape as shown in FIG. 49B, and a shape inclined with respect to the optical axis S as shown in FIG. 49C.

In the first, second, third, and fourth embodiments, NURBS as a free curved surface for light distribution is formed on each front surface and rear surface of the lenses 1A, 1B, 1C, and 1D. In this invention, however, the free curved surface for light distribution or the torus curved surface other than NURBS may be formed on the front surface and rear surface of the lenses 1A, 1B, 1C, and 1D.

In this invention, NURBS as the free curved surface for light distribution, free curved surface, or the torus curved surface may be formed on either the front surface or the rear surface of the lenses 1A, 1B, 1C, and 1D.

Further, in this invention, NURBS as the free curved surface for light distribution, free curved surface, and the torus curved surface may not be formed on the front surface and rear surface of the lenses 1A, 1B, 1C, and 1D.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A lamp device for vehicle comprising a light source, a reflector whose reflecting surface is a free curved surface, and a lens without a prism, wherein light reflected by said reflector passes through said lens to be radiated to the outside as a target light distribution pattern, wherein said lens has a concave shape in vertical cross section and a flat shape in transverse cross section.

2. The lamp device for vehicle according to claim 1, wherein the reflecting surface of said reflector is a substantially ellipsoidal surface in vertical cross section, which is greater than said lens, and is a substantially paraboloidal surface in transverse cross section, which is substantially the same size as said lens.

3. The lamp device for vehicle according to claim 2, wherein the free curved surface formed on the reflecting surface of said reflector is a Non-Uniform Rational B-Spline Surface (NURBS).

4. The lamp device for vehicle according to claim 3, wherein a torus curved surface or a free curved surface is formed on the front surface and/or the rear surface of said lens.

5. The lamp device for vehicle according to claim 2, wherein a torus curved surface or a free curved surface is formed on the front surface and/or the rear surface of said lens.

6. The lamp device for vehicle according to claim 1, wherein the free curved surface formed on the reflecting surface of said reflector is a Non-Uniform Rational B-Spline Surface (NURBS).

7. The lamp device for vehicle according to claim 6, wherein a torus curved surface or a free curved surface is formed on the front surface and/or the rear surface of said lens.

8. The lamp device for vehicle according to claim 1, wherein a torus curved surface or a free curved surface is formed on the front surface and/or the rear surface of said lens.

9. A lamp device for vehicle comprising a light source, a reflector whose reflecting surface is a free curved surface, and a lens without a prism, wherein light reflected by said reflector passes through said lens to be radiated to the outside as a target light distribution pattern, wherein said lens has a flat shape in vertical cross section and a concave shape in transverse cross section.

10. The lamp device for vehicle according to claim 9, wherein the reflecting surface of said reflector is a substantially paraboloidal surface in vertical cross section, which is substantially the same size as said lens, and is a substantially ellipsoidal surface in transverse cross section, which is greater than said lens.

11. The lamp device for vehicle according to claim 10, wherein the free curved surface formed on the reflecting surface of said reflector is a Non-Uniform Rational B-Spline Surface (NURBS).

12. The lamp device for vehicle according to claim 11, wherein a torus curved surface or a free curved surface is formed on the front surface and/or the rear surface of said lens.

13. The lamp device for vehicle according to claim 10, wherein a torus curved surface or a free curved surface is formed on the front surface and/or the rear surface of said lens.

14. The lamp device for vehicle according to claim 9, wherein the free curved surface formed on the reflecting surface of said reflector is a Non-Uniform Rational B-Spline Surface (NURBS).

15. The lamp device for vehicle according to claim 14, wherein a torus curved surface or a free curved surface is formed on the front surface and/or the rear surface of said lens.

16. The lamp device for vehicle according to claim 9, wherein a torus curved surface or a free curved surface is formed on the front surface and/or the rear surface of said lens.

17. A lamp device for vehicle comprising a light source, a reflector whose reflecting surface is a free curved surface, and a lens without a prism, wherein light reflected by said reflector passes through said lens to be radiated to the outside as a target light distribution pattern, wherein said lens has a convex shape in vertical cross section and a flat shape in transverse cross section.

18. The lamp device for vehicle according to claim 17, wherein the reflecting surface of said reflector is a substantially hyperboloidal surface in vertical cross section, which is smaller than said lens, and is a substantially paraboloidal surface in transverse cross section, which is substantially the same size as said lens.

19. The lamp device for vehicle according to claim 18, wherein the free curved surface formed on the reflecting surface of said reflector is a Non-Uniform Rational B-Spline Surface (NURBS).

20. The lamp device for vehicle according to claim 19, wherein a torus curved surface or a free curved surface is formed on the front surface and/or the rear surface of said lens.

21. The lamp device for vehicle according to claim 18, wherein a torus curved surface or a free curved surface is formed on the front surface and/or the rear surface of said lens.

22. The lamp device for vehicle according to claim 17, wherein the free curved surface formed on the reflecting surface of said reflector is a Non-Uniform Rational B-Spline Surface (NURBS).

23. The lamp device for vehicle according to claim 22, wherein a torus curved surface or a free curved surface is formed on the front surface and/or the rear surface of said lens.

24. The lamp device for vehicle according to claim 17, wherein a torus curved surface or a free curved surface is formed on the front surface and/or the rear surface of said lens.

25. A lamp device for vehicle comprising a light source, a reflector whose reflecting surface is a free curved surface, and a lens without a prism, wherein light reflected by said reflector passes through said lens to be radiated to the outside as a target light distribution pattern, wherein said lens has a flat shape in vertical cross section and a convex shape in transverse cross section.

26. The lamp device for vehicle according to claim 25, wherein the reflecting surface of said reflector is a substantially paraboloidal surface in vertical cross section, which is substantially the same size as said lens, and is a substantially hyperboloidal surface in transverse cross section, which is smaller than said lens.

27. The lamp device for vehicle according to claim 26, wherein the free curved surface formed on the reflecting surface of said reflector is a Non-Uniform Rational B-Spline Surface (NURBS).

28. The lamp device for vehicle according to claim 27, wherein a torus curved surface or a free curved surface is formed on the front surface and/or the rear surface of said lens.

29. The lamp device for vehicle according to claim 26, wherein a torus curved surface or a free curved surface is formed on the front surface and/or the rear surface of said lens.

30. The lamp device for vehicle according to claim 25, wherein the free curved surface formed on the reflecting surface of said reflector is a Non-Uniform Rational B-Spline Surface (NURBS).

31. The lamp device for vehicle according to claim 30, wherein a torus curved surface or a free curved surface is formed on the front surface and/or the rear surface of said lens.

32. The lamp device for vehicle according to claim 25, wherein a torus curved surface or a free curved surface is formed on the front surface and/or the rear surface of said lens.

* * * * *